US011287092B1

(12) United States Patent
Pertsch

(10) Patent No.: US 11,287,092 B1
(45) Date of Patent: Mar. 29, 2022

(54) REFLECTED LIGHT DEVICE

(71) Applicant: John Louis Pertsch, Hillsborough, CA (US)

(72) Inventor: John Louis Pertsch, Hillsborough, CA (US)

(73) Assignee: John Louis Pertsch, Burlingame, CA (US)

( * ) Notice: Subject to any disclaimer, the term of this patent is extended or adjusted under 35 U.S.C. 154(b) by 0 days.

(21) Appl. No.: 16/543,615

(22) Filed: Aug. 19, 2019

Related U.S. Application Data

(60) Provisional application No. 62/719,622, filed on Aug. 18, 2018.

(51) Int. Cl.
*F21K 9/68* (2016.01)

(52) U.S. Cl.
CPC ..... *F21K 9/68* (2016.08)

(58) Field of Classification Search
CPC .... F21K 9/68; F21S 4/24; F21S 10/06; F21W 2121/00; A63H 3/006; A63H 1/24; A63H 11/00; A63H 29/04
See application file for complete search history.

(56) References Cited

U.S. PATENT DOCUMENTS 2,857,507 A * 10/1958 Stec ..... F21V 23/00 40/432
4,085,541 A 4/1978 Mapp
4,307,528 A * 12/1981 Dewees ..... F21V 7/28 40/433
5,562,459 A * 10/1996 Durlach ..... G09F 11/025 345/110
5,791,775 A 8/1998 Douglass, II
5,795,630 A * 8/1998 Shapiro ..... B44C 5/00 40/414
6,183,100 B1 * 2/2001 Suckow ..... B60Q 1/2611 362/35
6,315,427 B1 11/2001 Simon
6,592,423 B1 * 7/2003 Boyle ..... A63H 33/22 362/323
6,802,758 B2 10/2004 Somers
6,994,605 B2 2/2006 Baxter
7,033,035 B2 * 4/2006 Fatemi ..... A63H 33/22 362/272
7,229,182 B2 6/2007 Schrader
8,641,241 B2 2/2014 Farmer
9,132,360 B2 9/2015 Rosenzweig
9,421,452 B2 * 8/2016 Carlow ..... A63F 9/0842
9,587,804 B2 3/2017 Chen
(Continued)

OTHER PUBLICATIONS https://www.ebay.co.uk/itm/Ceiling-LED-Luxury-Light-13-W-Dining-Room-Lamp-Design-Rings-Chrome-Rotating-/352072959199.
(Continued)

*Primary Examiner* — Peggy A Neils

(57) ABSTRACT

A reflected light device to make a lighting display comprises at least one frame, at least one connecting element, at least one reflective element, and at least one light source. The at least one connecting element attaches to the at least one frame, the at least one reflective element attaches to the at least one connecting element, and the at least one light source is directed at the at least one reflective element. Illumination projecting onto the at least one reflective element is redirected to provide a user with a pleasant display.

20 Claims, 12 Drawing Sheets

(56) References Cited

U.S. PATENT DOCUMENTS

| | | | | |
|---|---|---|---|---|
| 9,964,293 | B2 | 5/2018 | Devlin | |
| 2004/0004828 | A1 | 1/2004 | Chernick | |
| 2004/0145886 | A1 | 7/2004 | Fatemi | |
| 2005/0239367 | A1* | 10/2005 | Fernandez | A23G 3/563 446/73 |
| 2013/0107520 | A1* | 5/2013 | O'Kane | F21V 14/04 362/235 |
| 2015/0182867 | A1 | 7/2015 | Kelly | |
| 2016/0332018 | A1 | 11/2016 | Granat | |
| 2018/0129129 | A1* | 5/2018 | Seger | G03B 21/001 |
| 2018/0200618 | A1 | 7/2018 | Frisco | |
| 2018/0261132 | A1 | 9/2018 | Stoewahse | |
| 2018/0326318 | A1 | 11/2018 | Blumenfeld | |

OTHER PUBLICATIONS https://www.lumens.com/concentric-led-pendant-by-et2-lighting-ET2P96920.html.
https://www.italianlightstore.com/15171-o-ring-ondaluce-ciciriello-sospensione-led-4-anelli-concentrici-design-moderno.html.
media.designerpages.com/2012/09/heliocentric-models-copernico-by-artemide/.

* cited by examiner

FIG. 1D
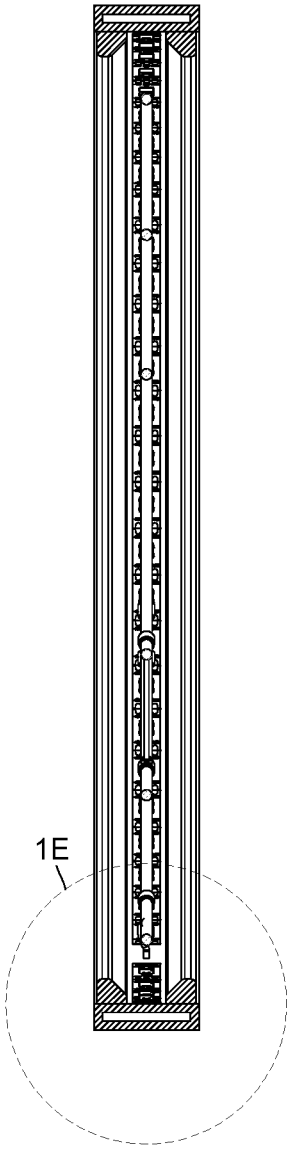
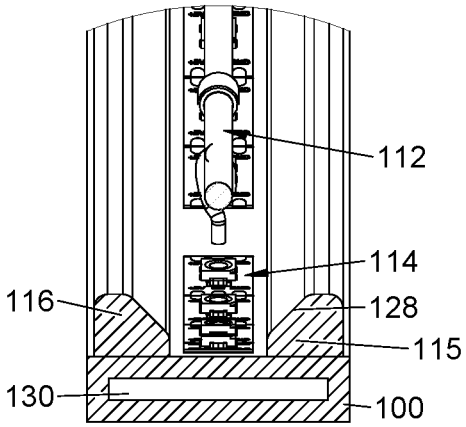
FIG. 1E
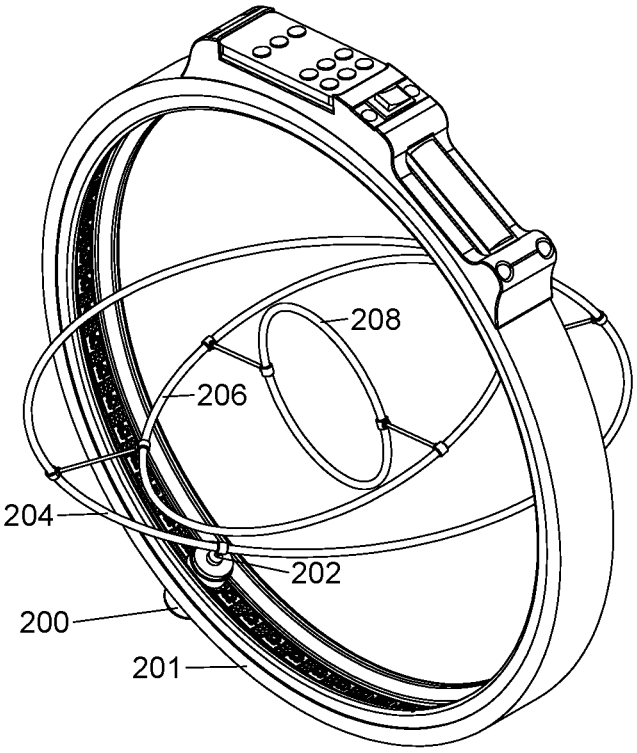
FIG. 2

REFLECTED LIGHT DEVICE

CROSS REFERENCE TO RELATED APPLICATIONS

This application claims the benefit of provisional patent application No. 62/719,622, filed Aug. 18, 2018 by the present inventor, which is incorporated by reference in its entirety.

FIELD OF THE INVENTION

This invention relates to the field of devices for creating light displays. Specifically, the present invention relates to a device that utilizes reflected light to provide entertainment to the user and onlookers.

BACKGROUND OF THE INVENTION

Many commercially available toys or illuminated articles utilize light to produce interesting displays. Such devices may also incorporate movable or motorized elements to yield added interest. Different devices can create different displays and patterns, with some utilizing persistence of vision effects. However, the results created by distinct devices of this type ultimately look quite similar—the visual experience for a user is limited to the direct viewing of source lighting. This source lighting usually only consists of a few points as well.

The prior art also includes illuminated articles and light fixtures comprising multiple movable elements that emit light. However, the placement of light sources on movable elements will ultimately restrict their motion—the need for wiring restricts the amount of motion that each movable element may experience. Furthermore, the inclusion of light sources on the movable elements will ultimately cause emitted light to directly shine at a viewer. The direct viewing of bright lights can be painful—not ideal for producing a display for an audience. Such light fixtures are also typically used for producing ambient room lighting. As a result, they typically use light of a single color and may not take advantage of dynamic lighting effects.

What is needed is a device that can provide an engaging lighting display and that does not fully rely on direct viewing of source lighting.

BRIEF SUMMARY OF THE INVENTION

In accordance with one or more embodiments, a reflected light device comprises at least one frame, at least one connecting element attached to a frame, at least one reflective element attached to a connecting element, and at least one light source directed at the reflective element. Light generated by the one or more light sources may impinge upon one or more reflective elements to produce a visual display.

In one or more embodiments, different approaches may be employed to alter the nature the resulting display. In some embodiments, a plurality of reflective elements may be used. In others, one or more connecting elements permit motion in one or more reflective elements. One or more kinematic assemblies of reflective elements may be thus created, capable of redirecting emitted light in an intriguing way.

One or more embodiments may use one or more dynamic light sources, which are capable of changing in brightness, color, or both. Certain types of dynamic light sources may also be addressable, permitting individual or grouped control of a plurality of light sources. In an addressable light source configuration, colorful patterns, chases, and strobing effects that change with time may be produced. The one or more reflective elements may then redirect the changing light to a viewing audience. One or more embodiments further comprise partial concealment of light sources to reduce their direct visibility to an audience.

One or more embodiments make use of additional elements—these might include one or more propulsive elements, electronic user controls, stands, power sources, accessory features, other elements, or other features, or some combination of these. One or more embodiments may be tailored for specific purposes or uses through the use of different combinations of these additional elements.

To use one or more embodiments, a user may turn on electronic components, hold a frame, impart motion to the lit reflective elements, and view the resulting display for entertainment purposes. In one or more embodiments, a propulsive element, stand, or both may facilitate operation without active user involvement. To use such an embodiment, a user may turn on electronic components and observe from a distance the automatic operation of these embodiments.

BRIEF DESCRIPTION OF THE SEVERAL VIEWS OF THE DRAWING

In the drawings, closely related figures have the same number but different alphabetic suffixes. In this document, the term "embodiment" refers to embodiment of the present invention.

FIG. 1D shows a section view taken at the plane given in FIG. 1C.

FIG. 1E is a detail view of the section view given in FIG. 1D.

FIG. 2 is a view of an embodiment that includes at least one propulsive element.

DETAILED DESCRIPTION OF INVENTION

Figure 1A:
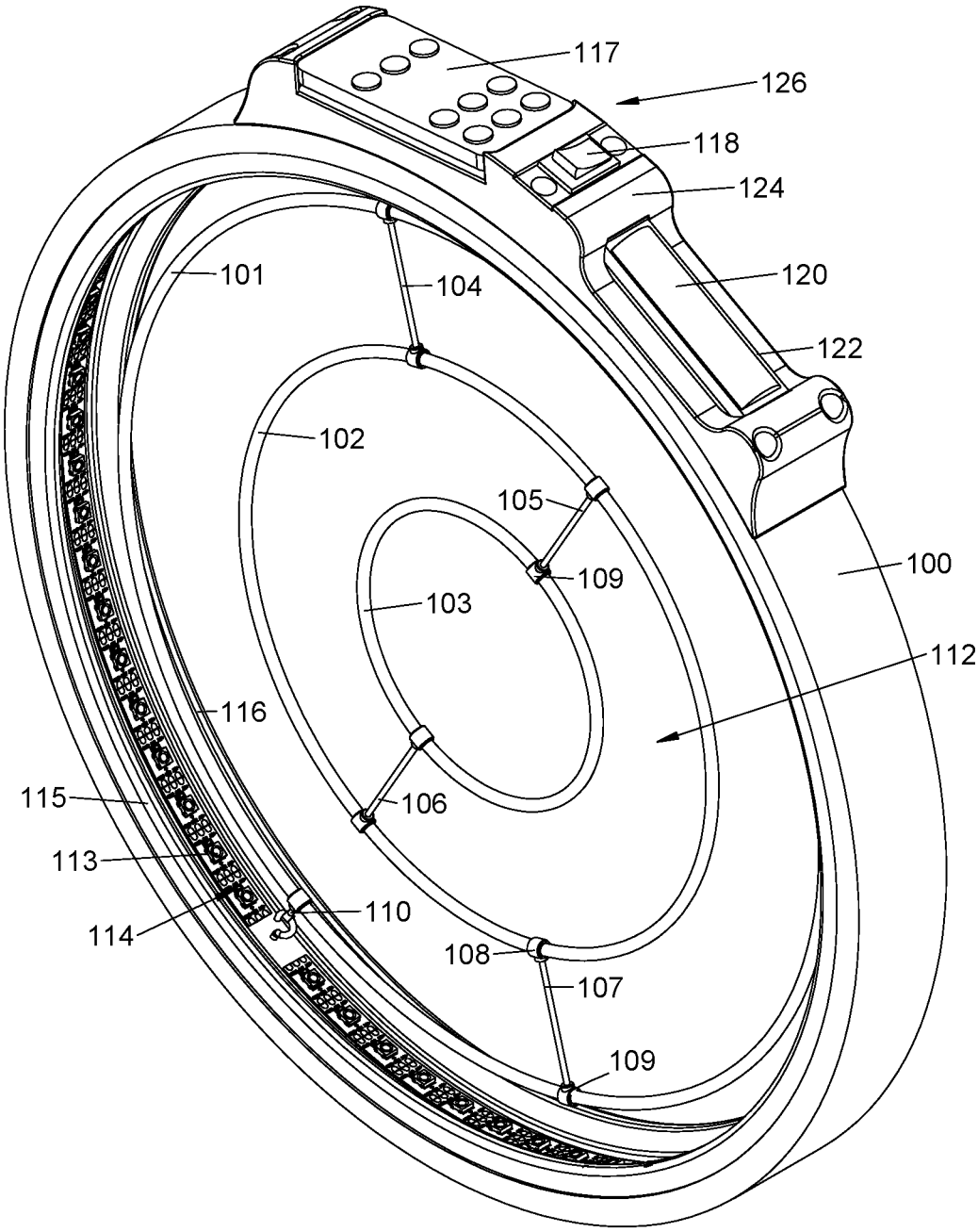
FIG. 1A shows an isometric view of one reflected light device embodiment.

In this document, several embodiments of a reflected light device are described in connection with the drawings.

One or more embodiments of a reflected light device may include one or more of the following elements, features, behaviors, character, and construction:

(a) At least one frame to support other elements:

(i) One or more embodiments make use of one or more frames of a planar form. Such planar forms may be either closed or open. Closed planar forms may include a hoop, a ring, a circle, a triangle, a square, a pentagon, a hexagon, an octagon, a parallelogram, other polygonal shapes, and other irregular closed forms. An open planar form may include an incomplete hoop or circle, an incomplete triangle, other incomplete polygonal forms, and other non-closed irregular forms.

(ii) One or more embodiments may use frames of a three-dimensional form. Such forms could include multiplanar forms, in which multiple planar forms are combined with an angle between their respective planes. Three-dimensional forms could also include cubes, pyramids, icosahedrons, dodecahedrons, and the like. In embodiments that utilize prismatic or polyhedron shapes as a basis for a frame, the edges of such shapes may be struts used to support other elements. Other three-dimensional forms of irregular character may also be considered for a frame in one or more embodiments.

(iii) A frame may be produced using a variety of methods. Molding of plastics, extrusion of plastics, resin casting, plastic casting, lamination of wood plies, steam bending of wood, extrusion of metals, and forming of metals may create suitable frames for some embodiments, though other techniques may be employed in other embodiments.

(iv) In some embodiments, a frame may possess a cross-section with an internal cavity, such as the hollow inside of a pipe or tube. In some cases, a cavity inside the frame could permit other components, such as electronics, to be stowed within the envelope of the frame cross section. A cavity could also provide a higher stiffness-to-weight ratio for the frame. In some embodiments, a frame with a cavity may be produced by an extrusion process, a multi-step molding process, or by another suitable forming procedure.

(v) In one or more embodiments, the frame may possess features that facilitate connection with other elements. Such elements may include holes, struts, depressions, bridges, crossmembers, surfaces suitable for adhesive bonding, and other features that facilitate connection.

(b) At least one light source:

(i) In one or more embodiments, one or more light sources are placed internally with respect to a frame. In other embodiments, one or more light sources are placed externally with respect to a frame. In yet other embodiments, one or more light sources may be placed both internally and externally with respect to a frame. In one or more embodiments, light sources may be placed at alternative locations.

(ii) In one or more embodiments, a single light source may be used. Examples may include a sheet of electroluminescent material, a single LED, a single OLED, other single point-like sources, or other single sheet-like sources.

(iii) One or more embodiments may make use of a plurality of light sources. LEDs arranged on a strip, OLEDs arranged along a strip, LED matrices, strings of LEDs and OLED matrices are some commonly available and inexpensive options. A sheet or strip with a high density of pixels—such as a thin and flexible TV display sheet—may also provide a plurality of light sources. Other types of light sources may also be used in a plurality. Other types of light sources may be arranged in a string, strip, a matrix, a flexible strip, a flexible matrix, or some other organization.

(iv) In some embodiments, one or more light sources may be static, maintaining a single fixed color. In such sources, brightness may be either constant or adjustable. Static lighting may be encountered in products such as Christmas tree light strings and fairy lights. Individual light sources in these examples hold fixed colors, though across the plurality, different individual sources may hold different fixed colors. An LED with a singular colored pixel, such as red, is another example of a single light source that is adjustable in brightness but not in color. One or more embodiments make use of static lighting to produce single- or multi-color lighting displays that do not vary in color with time.

(v) In some embodiments, one or more light sources may be dynamic, capable of changing with time properties such as color, brightness, or both. To give an example, dynamic lighting is a common feature of RGB LED sources. The availability of a red, a green, and a blue pixel of adjustable brightness in each such LED unit yields the dynamic capability.

(vi) Of the one or more embodiments with a plurality of dynamic light sources, some embodiments use non-addressable light sources. In a non-addressable plurality, all individual light sources must hold the same color and brightness value at a given moment in time. One common example is known as RGB strip lighting—though the strip color and brightness may be changed, all pixels must have the same color and brightness at a given moment.

(vii) Of the one or more embodiments with a plurality of dynamic light sources, some embodiments use addressable light sources. One or more embodiments make use of addressable light sources, which permit the display of time-varying light patterns. In an addressable light source plurality, each light source or group of sources is said to have its own unique address. This address, and therefore the light source, may be assigned a unique color state, brightness state, or both at any given moment in time. Pluralities of addressable light sources allow complex and color-varying illumination to be created, and the properties of this illumination may change quickly with time. Lighting chases, patterns, and other multicolored displays may be created. Sweeping rainbows, multicolored flashing, and blocks of color that appear to move along through space are some examples of the effects addressable light sources may produce. Common examples of addressable light source technology may include WS2811 strip, WS2812 strip, WS2812b strip, WS2813 strip, APA102 strip, APA104 strip, APA106 strip, SK6812 strip, matrices of the same designation, and strings of the same designation. One or more embodiments may utilize one or more of these technologies or other addressable light source technology. Using addressable technology, at least two light sources in a plurality of light sources will be capable of distinct variation in color, brightness, or both.

(viii) One or more embodiments make use of dynamic lighting to create single- or multi-color displays that vary with time. One or more embodiments make use of addressable light sources to make multi-colored displays that change with time. One or more embodiments sweep multi-colored displays across a plurality of light sources through the use of addressable lighting.

(c) at least one reflective element, which may redirect some of the light emitted by the one or more light sources to the user:

(i) One or more embodiments make use of reflective elements of a high reflectance, such as plated metals. Through various plating techniques, such as electroplating or electroless nickel plating, metals can achieve a mirror-like finish. Other embodiments may make use of reflective elements with alternate reflective and material qualities. Examples may include translucent materials, internally reflecting materials, metals with sanded finishes, sheet metals with sanded finishes, and plastics with reflective coatings applied. Other reflective materials may be considered for one or more embodiments.

(ii) Individual reflective elements may take a variety of forms. One or more embodiments may use planar reflective elements. Some embodiments use planar elements of a ring shape, also known as a torus. Ring-shaped and other plated metal forms are available at low cost through craft stores and other avenues. Such forms are usually fabricated from wire, then have a plating process applied. Other embodiments utilize alternate planar forms of similar construction, such as square-shaped objects, wheel-like spoked forms, other polygonal shapes, or other planar shapes of interest.

(iii) One or more embodiments may use three-dimensional forms. Some such forms may be generated through assembly of a wire lattice, bending of wire, forming of sheet metal, casting of a form, molding of a form, or through other techniques. Alternative three-dimensional forms may also be used, such as crystals, coin-like objects, prisms, spheres, objects with text cutouts, and other three-dimensional objects of interest.

(iv) One or more embodiments may utilize a flat sheet to create a reflective element of a different type. Flat metals are one option, though other flat materials may be used. Flat metals with sanded finishes are commonly referred to as "grained" sheet metals, and produce intriguing reflective effects when illuminated. Laser cutting, plasma cutting, or water jet cutting may yield reflective flat shapes of a variety of forms, though other manufacturing techniques may be used.

(v) For some embodiments that make use of a plurality of reflective elements, one or more reflective elements may be different in size, shape, and type. For instance, both square planar forms and ring-like planar forms may be used together in a given embodiment. Planar forms may also be used together with three-dimensional forms in one or more embodiments.

(vi) For some embodiments that make use of a plurality of reflective elements, one or more reflective elements may be arranged in a hierarchical manner. Such an organization is also referred to as nesting. In these cases, a reflective element may be placed within the space created by another reflective element of a larger size. For instance, a plurality of ring-like reflective elements of differing size may be arranged concentrically. In this case, the smaller ring elements will sit inside the larger ring elements.

(vii) In one or more embodiments, one or more reflective elements are placed internally with respect to a frame. In other embodiments, one or more reflective elements are placed externally with respect to a frame. In yet other embodiments, one or more reflective elements may be placed both internally and externally with respect to a frame.

(d) At least one connecting element, which may attach reflective elements to a frame, to one another, or to both a frame and one another:

(i) A connecting element may fix the elements it attaches to in place or it may permit them to move relative to one another.

(ii) In one or more embodiments, all connecting elements may be of the same design or same general design. In other embodiments, one or more in a plurality of connecting elements may differ in design.

(iii) A connecting element may comprise two or more distinct features—one may be known as an attachment feature and another as a spanning feature. An attachment feature serves to secure the connecting element to another element it may attach to. A spanning feature may serve cross the gap between the one or more other elements that the connecting element attaches to.

(iv) In one or more embodiments, one or more connecting elements may make use of a single component. Examples may include string—a knot or loop can serve as the attachment feature, while the string may span the gap between attached elements. Wire may also serve. Alternatively, a single over molded material may also form a single-component connecting element. The molding of material around another element may provide attachment, while the bulk molded material can span the gap between elements.

(v) In one or more embodiments, one or more connecting elements may comprise multi-component assemblies. A multi-component assembly may include components with distinct functions, such as attachment and spanning. Components used as attachment features may include metallic crimps, plastic crimps, molded plastic, adhesive, screw eyes, fasteners, pins, and other bodies with suitable attachment character. Components used as spanning features may include rigid members, elastic members, metal members, plastic members, rubber members, metal cable, wire, string, rope, silicone, and other bodies with mechanical properties that permit spanning. For some embodiments, one or more multi-component connecting elements may be formed through a multiple-shot molding process.

(vi) In one or more embodiments, connecting elements may use mechanical hardware as components. This hardware may form the connecting element itself, modify the performance of the connecting element, or perform some combination of these. Examples might include swivels like those used with fishing tackle, bearings, or springs.

(vii) In one or more embodiments, a connecting element could be formed by a simple interface by two other elements. If pin-like features are provided on one element, such as a reflective element, and hole features are provided on others, such as another reflective element or the frame, a revolute or cylindrical joint may be produced to serve as the connecting element.

(viii) In one or more embodiments, one or more connecting elements may store and release spring energy. Released spring energy is typically expressed as translational kinetic energy, rotational kinetic energy, or both. A body that stores and releases spring energy as rotational kinetic energy is known as a torsion spring. Having rotated in one direction for a period of time, a torsion spring will urge rotation in the reverse direction. A torsion spring attached to at least one inertial mass, such as a reflective element, can produce a pendulum-like effect. Torsion spring mechanics may be achieved through material choice, design, or both. Strings, rods, cables, rubber bands, and other materials can behave as a torsion spring when twisted.

(e) Partial concealment of light sources:

(i) The light source or light sources may be partially concealed in one or more embodiments. When an embodiment is viewed from certain perspectives, light concealment may serve to occult or reduce the apparent brightness of one or more light sources. As directly viewing some light sources may distract or blind the human eye, concealment can provide a more pleasant viewing experience of illuminated reflective elements. Lit reflective elements may appear brighter when light sources are obscured through partial concealment. In one or more embodiments, the partial concealment permits light emitted by the one or more light sources to impinge upon reflective elements, but not to reach an observer positioned at some locations.

(ii) Partial concealment of the one or more light sources may be achieved through a number of techniques. In some embodiments, the frame geometry may provision a recessed channel into which the one or more light sources are placed. In other embodiments, light sources may be placed into individual holes or pockets. In yet other embodiments, each light source may include a small shield that narrows their beam spread. Other frame-related concealment techniques may be used in one or more embodiments.

(iii) Lighting concealment may also be achieved through the addition of components in one or more embodiments. If the one or more light sources are arranged a narrow strip, a raised component may be installed along either or both sides of the strip to occult the light sources. One example could include placing adhesive-back strip of sufficient thickness along either side of a LED strip. Alternatively, a bead of a drying adhesive material, such as silicone, can be deposited along the sides of a light source to create a channel for concealment. Other types of components may also be considered to provide effective partial concealment.

(iv) Diffusers could provide partial concealment in one or more embodiments. Diffusers may reduce the apparent brightness to an audience.

(v) Partial concealment of lighting may be achieved through the use of polarizing technology or another optical filter in one or more embodiments.

(vi) In addition to occulting the one or more light source from an audience, the partial concealment may serve to increase the functional brightness of a light source in one or more embodiments. For instance, in an embodiment where a plurality of light sources is placed in a channel, the walls of the channel facing the light sources may be coated with a reflective material. This may permit a greater portion of the emitted light to be directed in a particular or useful direction.

(f) One or more power sources:

(i) One or more embodiments may utilize one or more electrical power sources to provide electricity to one or more elements.

(ii) An electrical power source could be portable, contained onboard an embodiment. Examples of portable electrical power sources could include rechargeable batteries, non-rechargeable batteries, lithium-ion batteries, lithium polymer batteries, nickel-metal hydride batteries, nickel cadmium batteries, capacitors, crank-driven generators, and other portable power sources.

(iii) One or more embodiments may also facilitate the exchange of a depleted portable electrical power source for a fresh electrical power source. For instance, in one or more embodiments, the battery compartment may be accessed by a user to permit the swapping of battery cells.

(iv) An electrical power source could be an external power source, facilitating the use of externally available electricity. Examples may include wall outlet adapters that convert alternating current to direct current. Some such devices are known as AC to DC adapters. External power sources may also include a DC-to-DC converters, an AC-to-AC converter, a DC-to-AC converter, a plug, a plug and cable, and wire leads.

(v) Other embodiments may use both portable and external electrical power sources. Of embodiments that use both, some embodiments may also provide the ability to charge a portable power source with the use of the external power source.

(vi) In one or more embodiments, one or power sources are detachable and may be removed by a user.

(g) One or more propulsive elements (i) In one or more embodiments, one or more propulsive element may be included to impart motion on one or more elements. Motion, in this document, can refer to rotation, translation, or a combination of both. Examples of propulsive elements may include motors, magnets, electromagnets, wind-driven features, spring-wound devices, and the like. In some embodiments, a motor may be used to impart rotation to a connecting element, which may subsequently impart rotation to a reflective element. In alternate embodiments, electromagnets may impart force upon one or more magnetic reflective elements to generate motion. In yet other embodiments, the propulsive element may be able to be wound up, like a clock, to slowly release energy over time. Other types of propulsive elements may be considered in one or more embodiments.

(ii) In one or more embodiments, one or more propulsive elements may be attached to the frame. In one or more embodiments, one or more propulsive elements may be attached to one or more other elements.

(h) One or more sensor elements:

(i) One or more embodiments make use of one or more sensor elements to trigger behavior in other electronic elements. Sensor elements could include a capacitive touch sensor, an accelerometer, a voltmeter, an ammeter, a light sensor, a microphone, a thermometer, and other available electronic sensors.

(ii) In one or more embodiments, a sensor element is used for safety. For instance, a thermometer, a voltmeter, or an ammeter could cut electrical power flow if an embodiment is used outside safe operating ranges.

(iii) In one or more embodiments, at least one sensor is used to modulate behavior of one or more light sources.

(i) One or more electronic user controls:

(i) One or more embodiments may additionally comprise one or more electronic user controls. An electronic user control could permit a user to trigger behavior in one or more electronic elements. For instance, an electronic user control could activate light source modes, propulsive element modes, alternative functions, or some combination of these. An electronic user control could also allow or cut electricity flowing from a power supply.

(ii) An electronic control could additionally comprise an interface including mechanical switches, capacitive switches, a touch screen, voice control, other input types, or some combination of these to permit a user to select these different modes. This interface may also comprise a graphical display in one or more embodiments. A graphical display could display information about control settings, modes, functions, the actively selected function or mode, or some combination of these.

(iii) The selection of different light source modes could allow the alteration of properties of the one or more light sources. These properties may include brightness, color, displayed patterns, displayed dynamic chases, other applicable properties, or some combination of these.

(iv) The selection of different propulsive element modes could turn the propulsive element on or off, change its speed, alter other properties of the element, or some combination of these.

(v) A user control could feature selectable alternative functions in one or more embodiments. One possible alternative function could be a timer, which may automatically turn off of one or more elements after a certain period of time. Another alternative function could be a sound reactive mode, in which the properties of the one or more light sources, propulsive elements, other device elements, or some combination of these may be modulated in response to sound. A motion-reactive mode could be another alternative function. If a user is handling an embodiment, motion may be detected through a motion sensing element, such as an accelerometer. A circuit connected to this sensor could initiate changes in the one or more light sources, one or more propulsive elements, other device elements, or some combination of these in response to the motion. Certain gestures or movements could trigger certain programmed changes. Instead of or in addition to being sensitive to general motion, a motion-reactive mode could also be sensitive to motion of specific device elements. For instance, a sensor could measure the motion of one or more reflective elements, triggering changes as a result. Another alternative function could be an automatic mode. In one or more embodiments, an automatic mode would automatically cycle through some or all of the various modes, functions, and other controller settings available to an embodiment at predetermined time intervals. In one or more embodiments, an automatic lighting mode would automatically cycle or shuffle through various lighting modes.

(vi) In one or more embodiments, an electronic user control may be physically attached to one or more other elements. In one or more embodiments, an electronic user control could operate while physically separate from other elements. For instance, an infrared control, radiofrequency control, smart phone application via Bluetooth, smart phone application via WIFI, or other remote control may communicate with onboard electronic hardware to initiate changes. In one or more embodiments, an electronic user control may be physically attached but detachable from one or more other elements.

(vii) In one or more embodiments, the electronic user control may only provide the user an ability to turn an embodiment device on or off. Once on, however, one or more of such embodiments may automatically cycle through various modes, functions, settings, or a combination of these.

(j) One or more accessory features (i) One or more embodiments of this device may make use of one or more accessory features. One or more accessory features may modify handling, wear-resistance, storage, mounting, customizability, or other qualities of an embodiment. An accessory may be used in isolation, with only one feature added, or in combination, with multiple features of one or more types used. An accessory feature may be attached on a permanent basis, not easily removed, or could be attached in a removable fashion.

(ii) An accessory feature may be incorporated directly into one or more other elements. In one or more embodiments, for instance, a handle accessory feature could be directly molded into a frame.

(iii) In one or more embodiments, an accessory feature could be a separate component. One example of an accessory feature added as a separate component could be a clip. Other off-the-shelf or custom hardware may also be considered for use as a separate component accessory feature.

(iv) An accessory feature could be a threaded hole, a through-hole, a threaded insert, a handle, a knob, a pole, a shaft, a d-ring, a clip, a carabiner, a rotating hold, a finger pocket, a knurled surface, a magnet, a hook, a stand, a stand with docking function, a self-propulsive mount, a self-propulsive hold, a quick-disconnect mount, an enclosure for electronic components, a suspension mechanism, a material for general protection and wear-resistance, a spare part, a carrying case, a noise-producing feature, a storage compartment for extra batteries, a weight, a strap, a name plate, a carrying case, a quick-disconnect fitting, a quick-disconnect fitting with electrical connectivity, or another modifying feature.

(v) One or more embodiments may use accessory features that facilitate suspension from a ceiling or other overhanging structure.

(vi) In one or more embodiments, an accessory feature could be one or more stands.

(i) In one or more embodiments, a stand aids display when an embodiment is not being handled by a user. In some embodiments, a stand may be secured to one or more other elements on a detachable or removable basis. In some embodiments, a stand may be permanently attached to one or more other elements.

(ii) Detachable securing could be achieved by the use of straps, hook-and-loop fastening materials, fasteners, magnets, clips, push-to-lock features, a guiding channel, a groove that offers stable connection, a combination of these, or other techniques that facilitate the attaching of two or more objects.

(iii) One or more embodiments could utilize a stand with docking capability. Docking capability refers to the ability of a given item to provide electrical power, data signals, or both to a temporarily attached device. For example, a docking stand could be connected to an external power source, and upon connection with other device elements, could transfer electricity to those other elements. Transferred electricity could charge an onboard battery, power one or more light sources, provide electricity to other device elements, or perform a combination of these.

(iv) A stand could comprise a multi-part assembly or a single part. A multi-part assembly may facilitate packaging for shipment of an embodiment.

(v) A stand could include feet features or components on the downward facing surface. In some cases, such components could prevent scratching to the surface supporting the stand. In these or other cases, the feet could slightly raise the stand to permit wiring to pass underneath.

(vi) A stand can comprise one or more features that facilitate placement of wiring, such as a channel, a hole, or some combination of these.

(vii) In one or more embodiments, a stand may additionally comprise one or more propulsive components.

(vii) In one or more embodiments, an accessory feature could be one or more enclosures for electronic components.

(i) An enclosure may hide wiring, protect electronic or other components, securely house a battery or other power source, support one or more electronic user controls, house a printed circuit board, perform a combination of functions, or perform other functions related to enclosures.

(k) One or more supporting electronic elements:

(i) One or more embodiments may make use of one or more supporting electronic elements. Some elements used in one or more embodiments can be electronic, such as the one or more light sources, the one or more propulsive elements, and other device elements. Such elements may require additional hardware to permit their proper function. In the case of the one or more light sources, the additional hardware may comprise a microcontroller to produce data signals, resistors, capacitors, a printed circuit board, and the like. A propulsive element may require a motor drive, a component to perform pulse-width modulation, or other necessary hardware. These and other supporting electronic components known to one skilled in the art may be used in one or more embodiments.

(l) One or more decorative features:

(i) One or more embodiments may make use of one or more decorative features. Decorative features may be incorporated into device features and elements such as a frame, an accessory feature, a reflective element, a combination of these, and other device features and elements.

(ii) Decorative features may include paint, fur, faux fur, color additives, molded decorative patterns, carved decorative patterns, wood finishes, the results of other decorative techniques, and other features of aesthetic value.

(iii) Though one or more embodiments may use decorative features for their principal aesthetic value, decorative features may also perform functional duties. For instance, a decorative pattern molded into a frame may also serve to improve gripping potential. The application of fur may additionally improve tactile sensation for a user.

(m) One or more alternative features, elements, behaviors, character, or construction:

(i) One or more embodiments may permit a user to modify or change programming. For instance, a user could upload new files to an embodiment that would permit the display of alternate light source behavior, such as different chases, colors, and other applicable properties of the one or more light sources. In one or more embodiments, a change of programming may alter the function of the electronic control—a given user input or button could be modified to produce a different device behavior. Programming could be changed through a standard communication interface, such as USB, together with a suitable computer-based programming tool. Such a communication interface could also be used as an external power source to supply an embodiment with electrical power. Alternatively, such communication could be accomplished through wireless techniques.

(ii) One or more embodiments may include connectivity potential. For instance, several copies of an embodiment may be able to communicate with one another such that electronic control commands expressed in one embodiment are replicated in another embodiment. Such communication could be achieved through wife, Bluetooth, or other wireless communication technique. Alternatively, such communication may be achieved through a wired approach. Connectivity potential may also be known as syncing of devices.

(iii) One or more embodiments may utilize other powered elements, such as sound-producing elements.

(iv) The use of foam components, such as the use of adhesive-backed foam strip for lighting concealment, can provide a pleasant tactile sensation when handling one or more embodiments. Attachment of fur can result in a similar end. Foam, fur, and other materials may be used to provide tactile enhancement for users.

(v) One or more embodiments may be said to be handheld. A user could operate these embodiments while holding them without undue effort. Though being handheld, one or more embodiments may still be compatible with a stand. A stand may be permanently attached in some handheld embodiments while removably attached in others.

(vi) Throughout this document, one or more elements in one or more embodiments have been referred to as being reflective. However, embodiments of similar construction may be produced in which the reflective elements exhibit alternative light-redirecting character. One embodiment may use one or more reflective elements that have fluorescent properties instead. In such an embodiment, the one or more light sources may emit ultraviolet radiation in lieu or in addition to light. The ultraviolet radiation will cause the one or more reflective elements to fluoresce, emitting visible light. Fluorescent materials that produce emissions of a variety of colors may be used.

(vii) As above, one additional alternative material character for the one or more reflective elements in one or more embodiments may be phosphorescence. Phosphorescent materials will absorb light and then slowly emit light over a period of time.

Detailed Description—First Embodiment

An embodiment of a reflected light device is shown in FIG. 1. A frame 100 has the shape of a hoop, a closed planar form. The frame supports a plurality of other elements. In the interior space surrounded by the frame are ring-like reflective elements 101, 102, and 103. These reflective elements are attached among each other by connecting elements 104, 105, and 106, and 107. The attachment features 108 and 109 for connecting element 107 securely attach it to reflective elements 102 and 103. Another connecting element, 110, attaches the outermost reflective element 101 to the frame. A connecting element similar to 110 is at a diametrically opposed location, obscured by the frame and other elements in this view. Connecting element 110 includes a screw eye to secure the element to the frame. In this embodiment, the aforementioned connecting elements permit distinct relative motion among the components to which they attach. This configuration also permits motion of at least one reflecting element relative to the frame. The aforementioned connecting elements also behave as torsion springs. Together, the connecting elements and reflective elements of this embodiment form the reflective assembly 112. In other embodiments, the reflective assembly designation may include one or more connecting elements and one or more reflective elements.

In this embodiment, the reflective assembly 112 is a multiple degree-of-freedom pendulum. This is due to the presence multiple inertial bodies, the plurality of reflective elements, and multiple torsion springs, the plurality connecting elements. The pendulating reflective assembly 112 also achieves a special kinematic condition. This condition is known as chaotic motion. It results from an arrangement of inertial members and restoring forces in which the motion of one inertial member is coupled to one or more others in a complex way. In this case, the plurality of inertial members are the reflective elements 101, 102, and 103. The plurality of restoring forces result from connecting elements 104, 105, 106, 107, 110, and the diametrically opposed pair to 110 functioning as torsion springs. Torsional springs store and release spring energy. A classical example of a kinematic system exhibiting chaotic motion is known as the double pendulum. A triple pendulum is another example of a chaotic system. This embodiment, with its three reflective elements and associated connecting elements, behaves in a fashion similar to a triple pendulum. Chaotic systems, such as the triple pendulum, are extremely difficult to predict the motion of, resulting in rich dynamic behavior. As an instance of a chaotic pendulating system, the reflective assembly 112 can achieve wildly erratic movements through modest inputs of energy. In FIG. 1A, this embodiment is shown at a rest state, in which no components are in motion.

Similar kinematic effects are not limited to this one embodiment—elements of one or more embodiments form a multiple degree-of-freedom pendulum. Elements of one or more embodiments form an assembly capable of chaotic motion.

The frame 100 also supports a light source 113. Many of these individual light sources are used such that a light source assembly 114 is circumferentially formed on the inner face of the frame. In one or more embodiments, the one or more light sources may only partially cover the available area of the frame. The plurality of light sources that form assembly 114 are both dynamic and addressable—in this embodiment, each light source may be assigned a color and brightness value that can change with time. A feature 115 may partially conceal the assembly of light sources when this embodiment is viewed from one or more perspectives. 116, a feature similar to 115, appears mirrored across a plane of this embodiment.

A number of other elements are also supported by frame 100. An electronic user control 117 permits a user to select various modes or properties of the light sources, as well as access other alternative functions available to this embodiment. In this embodiment, alternative functions may include a timer function, an automatic mode, and a motion-control mode. A second electronic user control 118 allows a user to quickly turn on and turn off this embodiment. In this embodiment, a distinctive design and location of the second electronic user control permit it to be located easily by a user, especially in the dark. In other embodiments, a single electronic user control may provide the capabilities of both 117 and 118. A portable power source 120 supplies electricity to the other electronic elements of this embodiment. This embodiment utilizes a rechargeable cylindrical chemical cell to provide electric power. This cell may be easily removed from its compartment 122 if needing to be exchanged with another cell. In this embodiment an enclosure 124 provides structure for the one or more electronic user controls, power source, power source holder, and other supporting electronic elements. The elements 117, 118, 120, 122, 124, and other supporting electronic elements form enclosure assembly 126. The enclosure 124 also houses an accelerometer sensor element, used for a motion-control mode for the plurality of light sources.

Figure 1B:
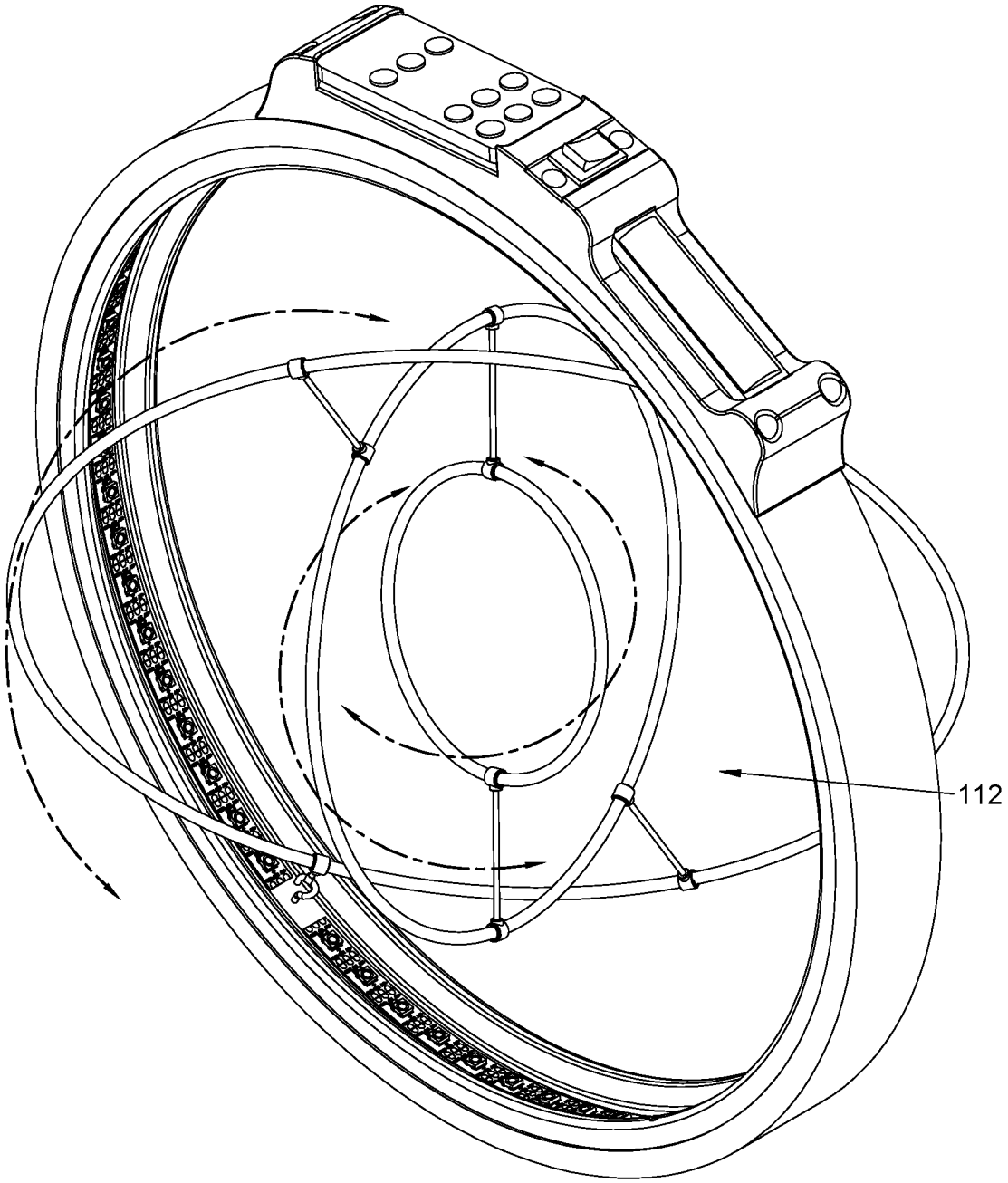
FIG. 1B depicts the embodiment from FIG. 1A with a plurality of elements in motion.

FIG. 1B, an isometric view of the same embodiment as FIG. 1A, shows the kinematic capabilities of this embodiment. The elements of reflective assembly 112 may move relative to one another and are illustrated having moved from their positions in FIG. 1B. The broken lines of this figure indicate a possible direction of motion, though different directions are possible. As the reflective assembly 112 is a multiple degree-of-freedom pendulum, some elements of this assembly will spin in one direction for a time, then attempt to reverse direction. A torsion spring connecting element will twist in one direction until at point of saturation, then it will seek to unwind itself in the opposite direction. The winding and unwinding of the one or more torsion spring connecting elements of this embodiment causes a pendulum effect in the one or more reflective elements. The differing sizes of reflective elements can result in differing accelerations, rotation rates, and speeds, producing additionally chaotic motion. Motion can be extremely complex, and the motion indicated in FIG. 1B is not intended to limit the scope of available motion capability.

A disclosure made on Nov. 22, 2017 depicts an embodiment in operation. A video may be accessed through the following link that demonstrates the complex motion of an embodiment: https://youtu.be/4kS44TrJc78

Figure 1C:
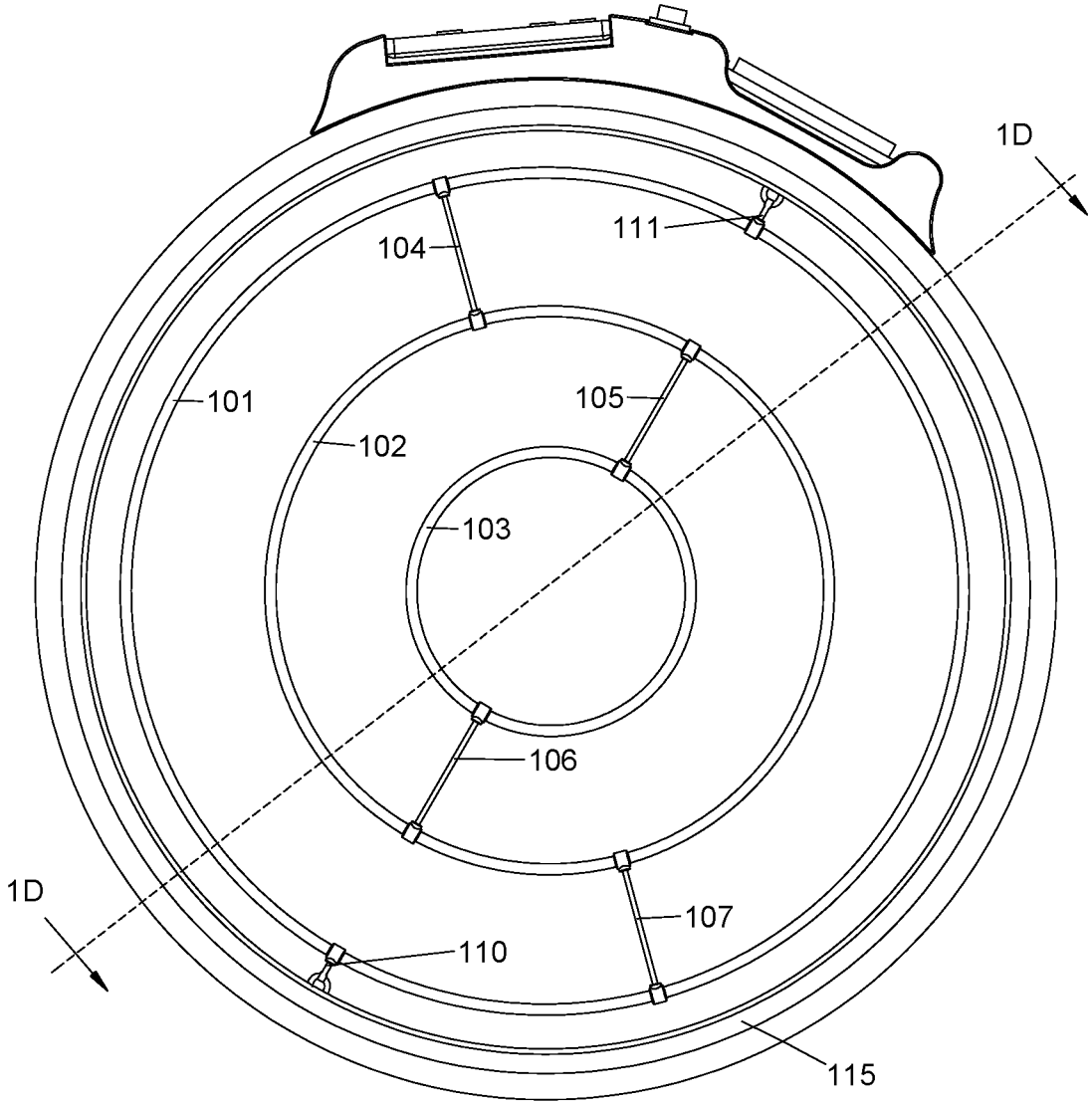
FIG. 1C shows a front plane view of the embodiment of FIG. 1A.

FIG. 1C shows a front plane view of the embodiment from FIG. 1A. The connecting element 111, diametrically opposed to connecting element 110, is apparent in this view. The light source assembly 114 is not visible from this perspective, obscured by concealment feature 115. The hierarchical assembly formed by the reflective elements 101, 102, and 103 is also apparent in this view. Concentrically oriented, the reflective elements of smaller diameter sit inside those of larger diameter. Also visible are the relative orientations of the connecting elements. When all reflective elements are sitting in plane with one another, connecting elements 105, 106, 110, and 111 are aligned along a similar axis. Connecting elements 104 and 107 are aligned along a different axis, approximately 45 degrees to the previous axis in this rest configuration of this embodiment. Placing connecting elements of different hierarchies at angles to one another may permit complex rotations to occur in the reflective elements. A 45-degree angle may facilitate motion transfer, meaning energy imparted to the one element of assembly 112 will propagate to the other elements and vice versa. Other orientations may also be used in other embodiments, and other orientations can also yield motion transfer, compound rotations, or both.

Connecting elements 105 and 106, which both attach reflective element 102 to 103, are aligned along a similar axis. Aligning connecting reflective elements in this way will help maintain the concentricity or centering of the other elements to which they attach. Specific alignments of connecting elements in one or more embodiments may also aid in positioning the center of gravity, center of rotation, or both.

FIG. 1D shows a section view along the plane indicated in FIG. 1C. FIG. 1D includes an indication of detail view FIG. 1E.

FIG. 1E is a detail view showing the features 115 and 116 that achieve partial concealment of the light source assembly 114. In this embodiment, features 115 and 116 are applied as separate components in a circumferential manner to frame 100. Adhesive-backed foam strip may be used, and such a foam strip may be produced by an extrusion process. In other embodiments, however, concealment features similar to 115 and 116 may be provisioned by the geometry of the frame.

The addition of 115 and 116 creates a channel in which light source assembly 114 resides. Light emitted by the light source assembly may pass unimpeded to the reflective assembly 112, illuminating the reflective elements contained within. A chamfer feature 128 may permit light sources to more effectively illuminate reflective elements that may move out of the plane of the light sources, such as in FIG. 1B. Also visible in this view is a cavity 130 within the cross section of frame 100.

An audience with a view comparable to that of FIG. 1C will not see the one or more light sources along a direct line of sight. This will have the practical effect of making the illuminated reflective elements appear relatively brighter. A user with a perspective similar to that of FIG. 1C may also experience lesser discomfort from the potentially bright light sources.

This embodiment is handheld, capable of being operated while held without undue effort by a user.

Manufacture—First Embodiment

A variety of different techniques, components, and steps may be used to manufacture different embodiments of the one or more embodiments of a reflected light device. A process for manufacturing first embodiment is described here, though other embodiments may utilize alternative approaches. One or more other embodiments may be very similar to the first embodiment, but may utilize different components, manufacturing steps, an alternative approach, or some combination of these.

To make an embodiment of the reflected light device, a frame is first selected. The first embodiment utilizes a hoop formed from an extruded thermoplastic. A plurality of light sources, such as an adhesive-backed addressable LED strip, is then attached circumferentially along the inner face of the frame. The light sources may be applied to direct away from the surface of the frame to which they attach. Features to partially conceal the plurality of light sources must next be installed. Adhesive-backed foam strips may be used, and these are placed along both sides of the plurality of light sources. A reflective assembly must now be made. Three ring-like reflective elements of different sizes are procured. The reflective elements are attached among each other through the use of a plurality of connecting elements. These connecting elements may be made of string. String knots may secure the connecting elements to the reflective elements. The reflective assembly may be attached to the frame by connecting elements that utilize screw eyes, a threaded screw. The screw eyes may be driven into the frame to provide a knot attachment location for string. The reflective assembly may thus be attached to the frame. Additional elements may then be attached. One or more electronic user controls, a power source, a holder for the power source, and other supporting electronic hardware may be secured to the frame through the use of an enclosure. A battery may be used as a portable power source. Wiring may be supplied such that the power source may provide electricity to other electrical elements, such as the one or more electronic user controls or the plurality of light sources. A printed circuit board contained within the enclosure may house other electronic components, such as a sensor element, microcontroller for LEDs, voltage regulators, battery protection circuit, a fuse, and others.

Operation—First Embodiment

One method of using a first embodiment is described here, though one or more other embodiments may be used through alternative methods.

To use a first embodiment of the reflected light device, a user holds the frame. The user then powers this embodiment on through one or more electronic user controls. A user may then select a particular setting to display on the one or more light sources of this embodiment. These settings may include single color static displays, multicolor static displays, dynamic chases, dynamic patterns, strobing effects, rainbow effects, color fades, and other static or dynamic lighting effects.

Upon selecting a setting to display, light will emit from the one or more light sources and some of this light will impinge upon the reflective elements. Being of shiny character, the reflective elements will redirect the effects generated by the one or more light sources in a captivating manner. With sufficient reflectivity in the reflective elements and sufficient relative brightness of the light sources, the reflective elements will lose their apparent natural color and appear to take on the one or more colors provided by emitted light. Some of the emitted light will blocked by partial concealment features to prevent the source lighting from distracting the user.

The user may then choose to initiate the kinematic effects of the reflective assembly. By giving a gentle push to one or more of the reflective elements, the user can trigger a cascade of motion to all the reflective elements. This cascade of motion will be due to the hierarchical organization of the reflective assembly. The torsion spring nature of the connecting elements will permit a single impulse by a user to yield a pendulating motion for an extended period of time. As the reflective assembly is a chaotic system in this first embodiment, the resultant motion will be complex and unpredictable. The user may continue to push one or more of the reflective elements to insert more energy into the system, thereby prolonging motion. Motion may also be imparted by spinning, twirling, or otherwise manipulating the frame.

To create different visual effects, the user can activate alternative functions, modes, or settings available on the one or more electronic user controls. The user may choose to utilize this embodiment in dark ambient lighting conditions, as the illuminated reflective elements may better take on the colorful effects of the light sources. As this embodiment is handheld, the user may choose to carry it to a desired location to engage with the display. A user may also choose to dance with this embodiment. If moving fast enough, the one or more reflective elements of this embodiment or others may yield appealing persistence of vision effects. For instance, the rings of this embodiments will take on a spherical character when rotating quickly enough in a low ambient lighting.

This first embodiment may thus be used create a mesmerizing and captivating visual to entertain an audience, though other techniques and uses may also be apparent.

Detailed Descirption—Alternative Embodiments

FIG. 2—An embodiment with propulsive element.

FIG. 2 shows an embodiment using a propulsive element 200 connected to the frame 201. In this embodiment, the propulsive element may impart rotation to connecting element 202, which then imparts a rotation on reflective element 204. Motion may be transferred through other connecting elements to initiate motion in reflective elements 206 and 208. In this embodiment, an electronic user control could permit turning on, modulating, and selecting a mode for the propulsive element in addition to controlling other elements. More than one propulsive element may be used in one or more other embodiments—for instance, another element similar to 200 could be positioned at a diametrically opposed location in another embodiment.

Figure 3:
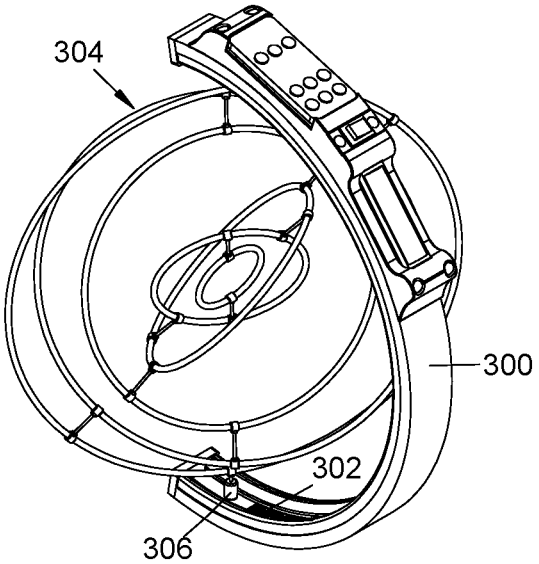
FIG. 3 is a view of an embodiment that includes a frame of an open planar form.

FIG. 3—An embodiment with frame of open planar form.

FIG. 3 shows an embodiment with a frame 300 of an open planar form. The frame in this case is a partial hoop. A partial hoop would sit flat on a surface, hence being planar. It does not close upon itself, as a circle might, resulting in an open form. In this embodiment, the planar frame shape is a semicircle. The open planar frame design would permit a user to easily manipulate the reflective assembly 304. As a closed planar frame, such as a hoop, would block access from some directions. A frame of open planar design may be lighter than a frame of closed planar design of a similar cross section. If a user observes this embodiment from the isometric view shown in FIG. 3, there are few of light sources 302 visible to the viewer. While few light sources are visible, a plurality of elements would still appear illuminated from this perspective. This embodiment also incorporates a connecting element that uses a bearing 306. This might facilitate continuous rotation in a single direction, especially if the diametrically opposed connecting element also uses a bearing. One or more embodiments have at least one connecting element that uses additional hardware, such as a bearing.

Figure 4:
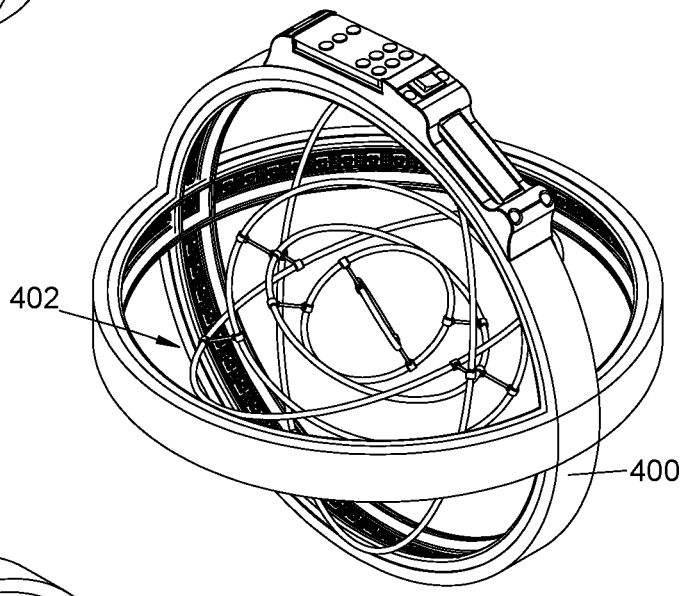
FIG. 4 is a view of an embodiment that includes a frame of a closed multi-planar form.

FIG. 4—An embodiment with frame of closed multiplanar form.

FIG. 4 shows an embodiment with a frame 400 of a closed multiplanar closed form. The geometry of the frame 400 resides in more than one plane, with each planar portion of the frame forming a closed shape. In this embodiment, the planar shapes are circles, and the two circles sit in planes 90 degrees to one another. Such a frame would have a significant area available for the attachment of light sources, providing increased illumination of other attached elements. Other attached elements may include the reflective assembly 402.

Figure 5:
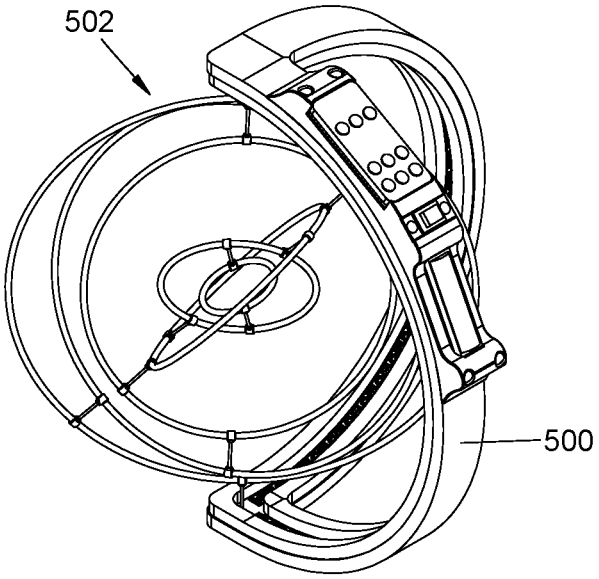
FIG. 5 is a view of an embodiment that includes a frame of an open multi-planar form.

FIG. 5—An embodiment with frame of open multiplanar form.

FIG. 5 shows an embodiment with a frame 500 of an open multi-planar form. In this embodiment, each planar form is a semicircle. The two semicircles rest in planes at 90 degrees to one another. In this embodiment, light sources are applied to the interior faces of both semicircular segments. This effectively doubles the illumination relative to a situation in which only one semicircular form of a similar size was available. As the reflective assembly 502 is not circumferentially enclosed, a user may have increased access by which to manipulate it.

Figure 6:
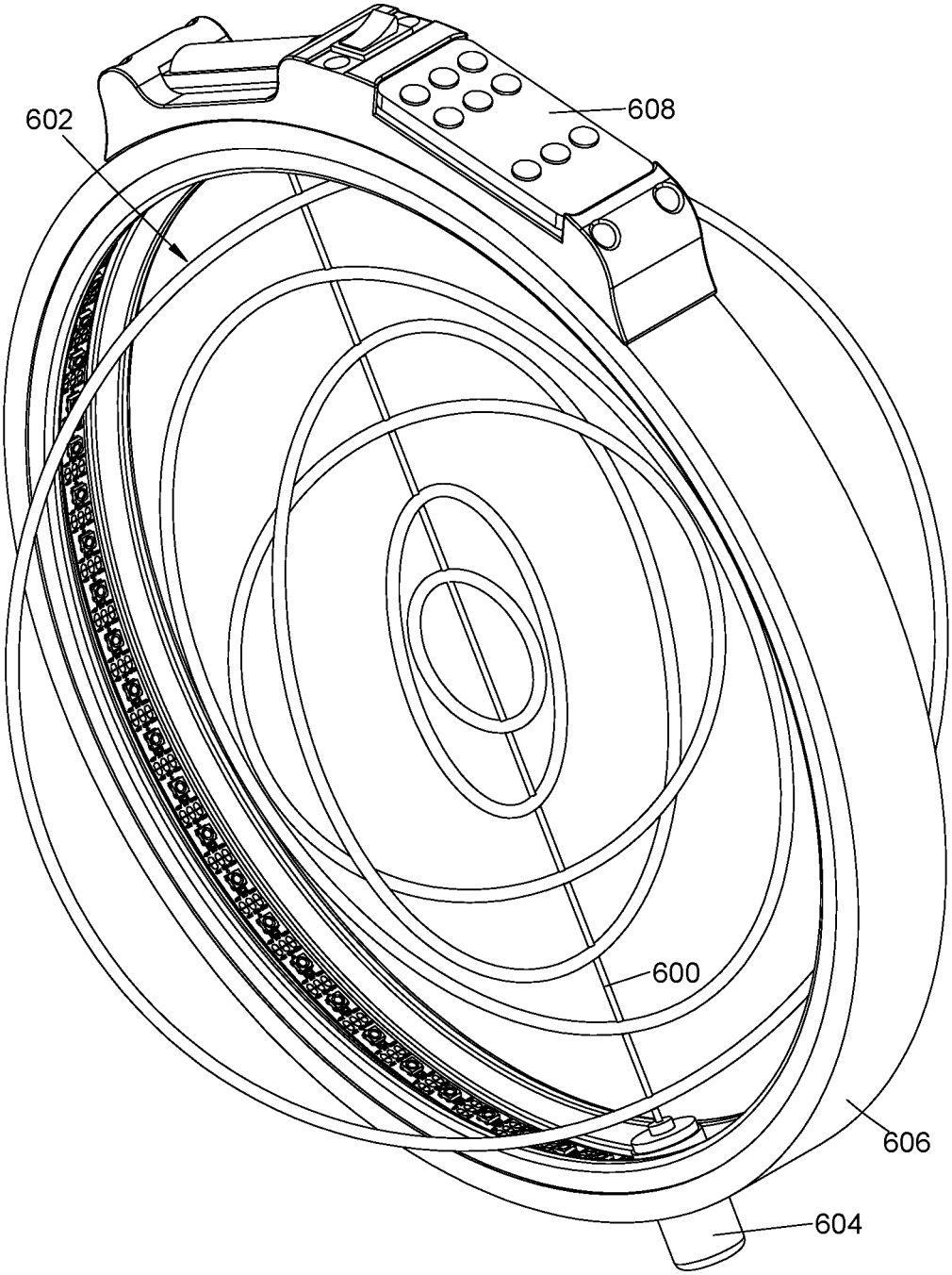
FIG. 6 shows a view of an embodiment with a plurality of reflective elements attached along a common axis by a singular connecting element.

FIG. 6—An embodiment with singular connecting element.

FIG. 6 illustrates an embodiment that uses a single connecting element 600 to provide connection among the elements of the reflective assembly 602, a propulsive element 604, and a frame 606. In this embodiment, the connecting element 600 may be a flexible wire, though other materials may be used in other embodiments. Connection between the other elements of the assembly and the connecting element 600 may be achieved through the use of adhesive. Connecting element 600 may pass through a hole provisioned on the reflective elements of the reflective assembly 602. Alternatively, in other embodiments, the connecting element may be looped around other elements to provide attachment.

The flexible wire of 600 may act as one or more torsion springs, permitting the elements of reflective assembly 602 to exhibit motion. A single connecting element may form multiple torsion springs in one or more embodiments, being able to rotate in the spanning area in between attachment points. The flexible wire of connecting element 600 together with the plurality reflective elements of assembly 602 may form a multiple degree-of-freedom pendulum. The singular connecting element of these embodiment attaches other elements along a single axis.

The embodiment of FIG. 6 features the propulsive element 604. The activities of this element may be altered by electronic user control 608. The electronic control 608 may also provide modulation of the light emitting elements of this embodiment.

Figure 7:
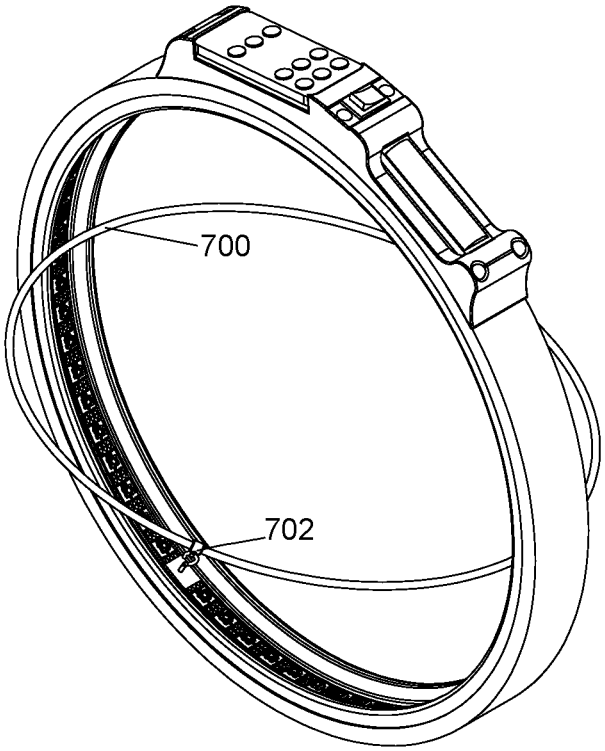
FIG. 7 shows a view of an embodiment with a single reflective element.

FIG. 7—An embodiment with singular reflecting element.

FIG. 7 illustrates an embodiment with a single ring-like reflective element 700. The embodiment of FIG. 7 may make use one or more dynamic light sources. The embodiment of FIG. 7 may also make use of a plurality of addressable light sources. The one or more connecting elements of this embodiment and the singular reflective element may form a single degree-of-freedom pendulum. Connecting element 702 may behave as a torsion spring and may have a diametrically opposed pair.

Figure 8:
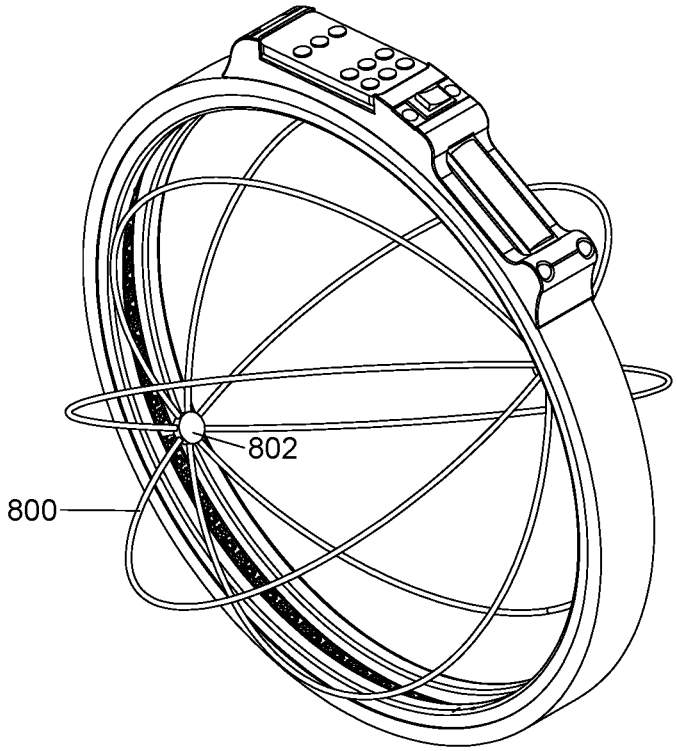
FIG. 8 shows a view of an embodiment with a single reflective element of a wire lattice form.

FIG. 8—An embodiment with alternate single reflecting element.

FIG. 8 shows another embodiment also with a singular reflective element. The singular reflective element 800 is a wire lattice made of a number of rib-like forms. These rib-like forms all meet at a union feature, 802. The reflective element 800, which includes the union feature 802, may be a single continuous piece of a cast or molded material. In an alternative embodiment, one or more rib-like forms may be separate reflective elements, joined by a separate component similar to union feature 802.

Figure 9:
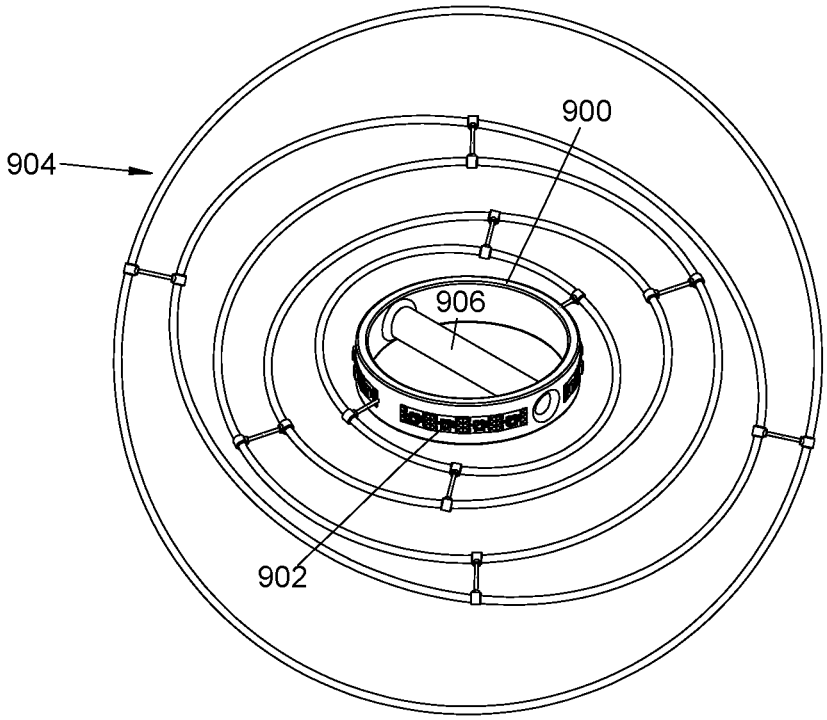
FIG. 9 shows a view of an embodiment in which at least one reflective element is positioned externally with respect to the frame.

FIG. 9—An embodiment with at least one reflecting element located externally to the frame.

FIG. 9 shows an embodiment in which the reflective elements of reflective assembly 904 are placed externally with respect to frame 900. A plurality of light sources 902 are directed outwards from frame 900 towards the reflective assembly. A user may hold this embodiment by crossmember feature 906 of frame 900.

Figure 10:
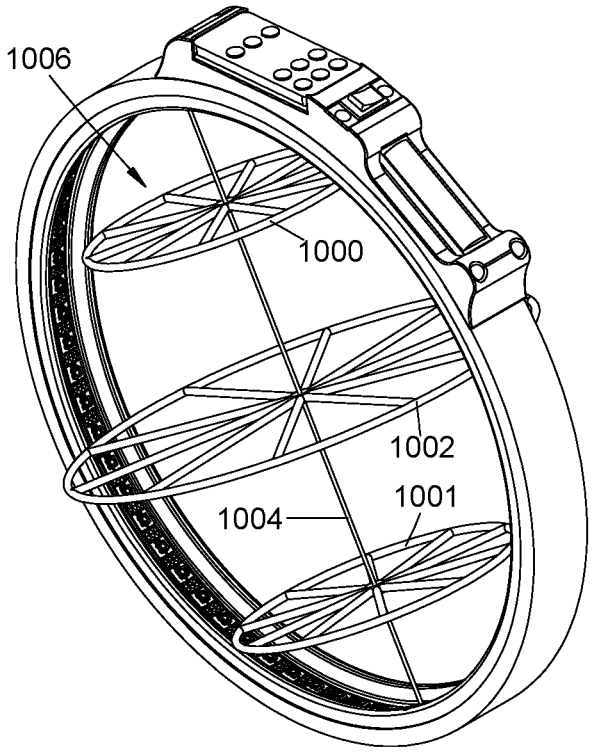
FIG. 10 shows a view of an embodiment with a plurality of reflective elements that do not nest inside each other.

FIG. 10—An embodiment with non-hierarchical arrangement of reflecting elements.

FIG. 10 shows an embodiment with a plurality of reflective elements 1000, 1001, and 1002. Together with the singular connecting element 1004, these elements for reflective assembly 1006. This embodiment features a plurality of reflective elements that are not arranged in a hierarchal assembly. The geometry of these reflective elements would prevent them from being placed one inside the other.

Figure 11:
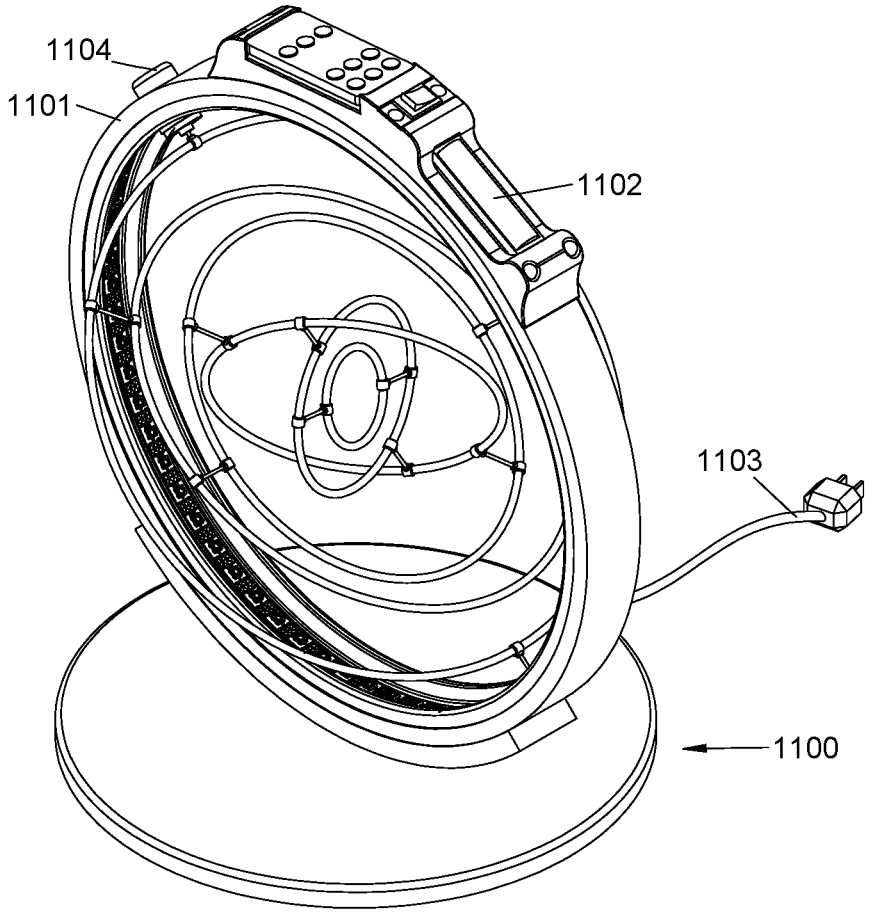
FIG. 11 shows a view of an embodiment that further comprises a stand.

FIG. 11—An embodiment with a stand.

FIG. 11 shows an embodiment that additionally comprises a stand. In this embodiment, the stand is an assembly of components, 1100. The stand assembly 1100 may removably attach to frame 1101. In other embodiments, the stand may not be detachable from other embodiment elements.

This embodiment makes use of a plurality of power supplies. One power supply is the portable power source 1102, possibly a battery. Another power supply is the external power source 1103. The external power source 1103 may transfer electricity to the other electronic elements. Other electronic elements may include one or more light sources, the propulsive element 1104, and the power source 1102.

Figure 12:
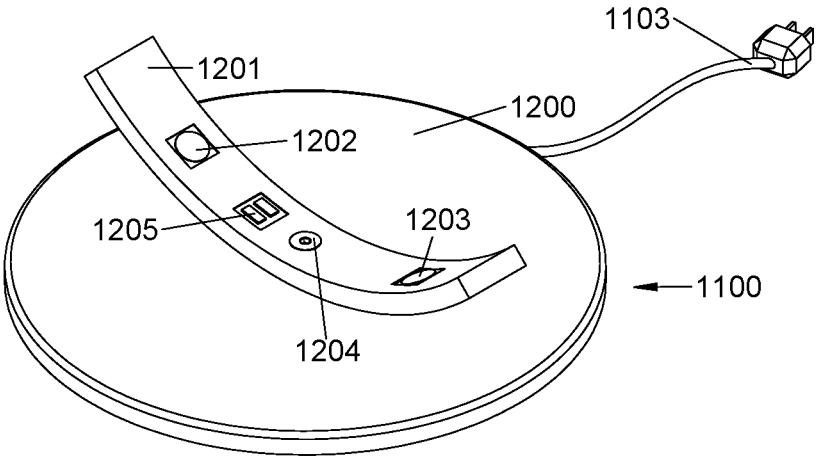
FIG. 12 illustrates a detail view of the stand from FIG. 11.

FIG. 12—A detailed view of the stand from FIG. 11.

Stand assembly 1100 is shown in detail in FIG. 12, detached from other elements of this embodiment. In this embodiment, the stand comprises a base 1200, a cradle 1201, magnets 1202 and 1203, connective hardware 1204, electrical contacts 1205, and external power source 1103. The base 1200 provides support for the other components of this embodiment. The magnets 1202 and 1203 permit removable attachment to frame 1101, which may also include magnetic features. The cradle 1201 provides additional support to frame 1101. The connective hardware 1204 provides additional security between the cradle 1201 and the stand base 1200. The electrical contacts 1205 facilitate the transfer of power from the external power source 1103 to other elements of this embodiment. In this embodiment, an opposing set of electrical contacts may be attached to frame 1103 and wired to other device elements. Being removably attached to the other device embodiments and also transferring power, the stand of this embodiment is said to have docking capability. Stands and stands with docking capability may be achieved through other methods in other embodiments.

To operate this embodiment, a user may first plug the external power source into an available external supply. One or more electronic elements of this embodiment, such as one or more light sources and a propulsive element, may then be turned on using an electronic user control. With motion generated by a propulsive element, direct contact with a user is not necessary to initiate motion in the one or more reflective elements. This embodiment may be placed on a table, shelf, or other point that permits it to be viewed by a user. This could provide passive illumination or aesthetic enjoyment. When a user so desires, he could detach the stand from other device elements. An onboard power source could then supply power to one or more electronic elements, such as the lighting. Detached from the stand, a user could then hold this embodiment by its frame or other element and interact with the remaining elements in a handheld fashion. When finished holding this embodiment, the user may reattach one or more device elements to the stand. Through its electrical contacts, the stand may then transfer electricity from the external power supply to one or more portable power supplies. The transfer activity may ready this embodiment for future handheld use. While attached to a stand, one or more electronic elements of this embodiment may remain on as long as external power source continues to supply electricity.

In one or more embodiments, the stand may be attached to one or more other device elements on a permanent basis. Such embodiments might also comprise an external power supply.

Figure 13:
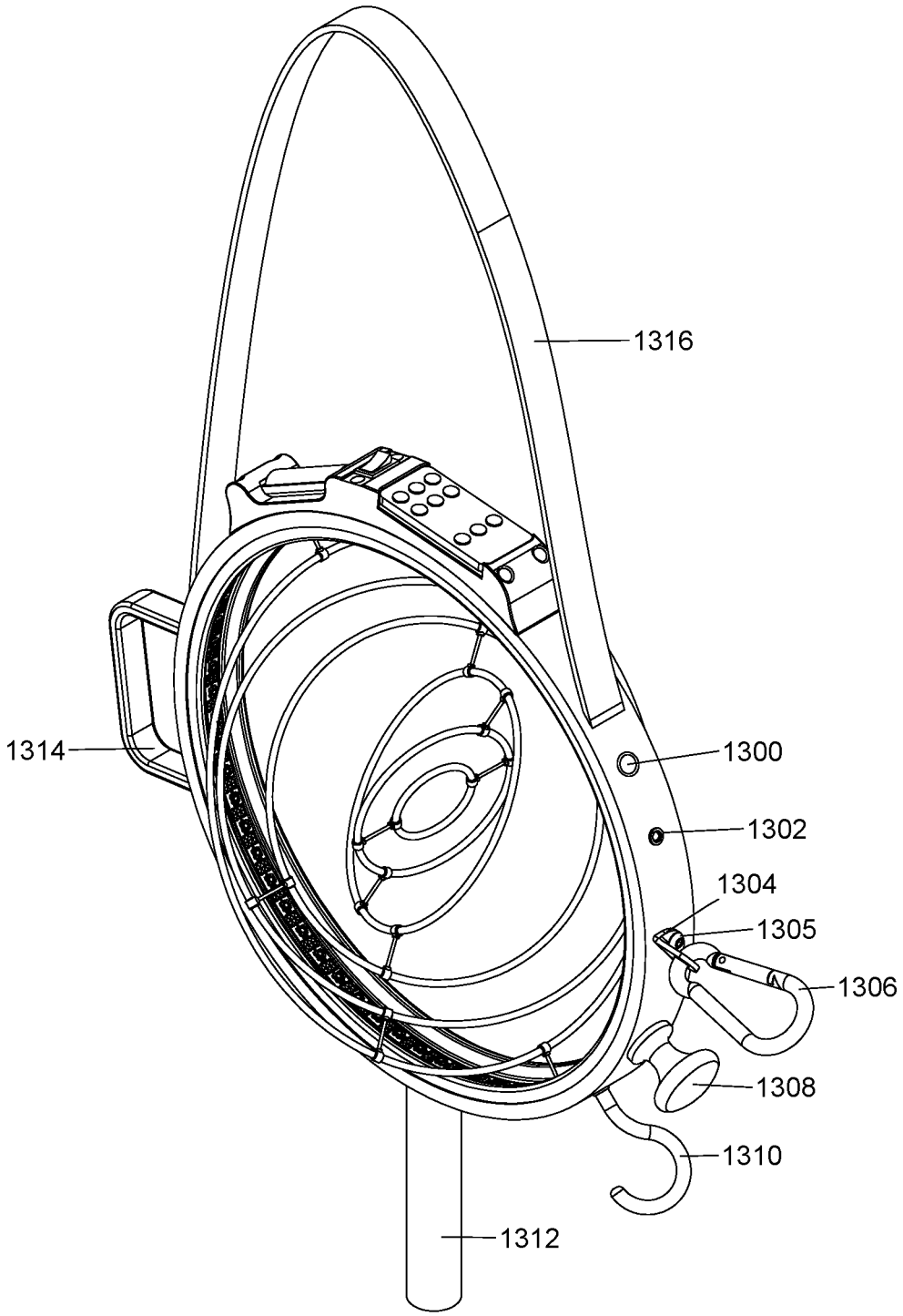
FIG. 13 depicts an embodiment incorporating a variety of accessory features.

FIG. 13—An embodiment with a plurality of accessory features.

An embodiment with a plurality of accessory features is shown in FIG. 13. These accessory features include a hole 1300, threaded hardware 1302, a bracket 1304, a fastener 1305, a clip 1306, a rotatable knob 1308, a rotatable hook 1310, a staff 1312, a rotatable handle 1314, and a strap 1316. In this embodiment, accessory features are shown attached to the frame.

Rotatable accessory features, such as the knob 1308, hook 1310, and handle 1314 of this embodiment, may facilitate overall manipulation of this and other embodiments. Knobs, hooks, and handles need not be rotatable in one or more embodiments, but may remain fixed relative to other elements. In one or more embodiments, a strap may facilitate wearing, carrying, or other mobility-related tasks. A clip, such as 1306, may facilitate carrying by attachment to one's person in one or more embodiments.

In one or more embodiments, one or more accessory features of one or more types may be used in isolation or as a plurality. One or more embodiments may use none, one, or a plurality of accessory features of one or more types.

Figure 14:
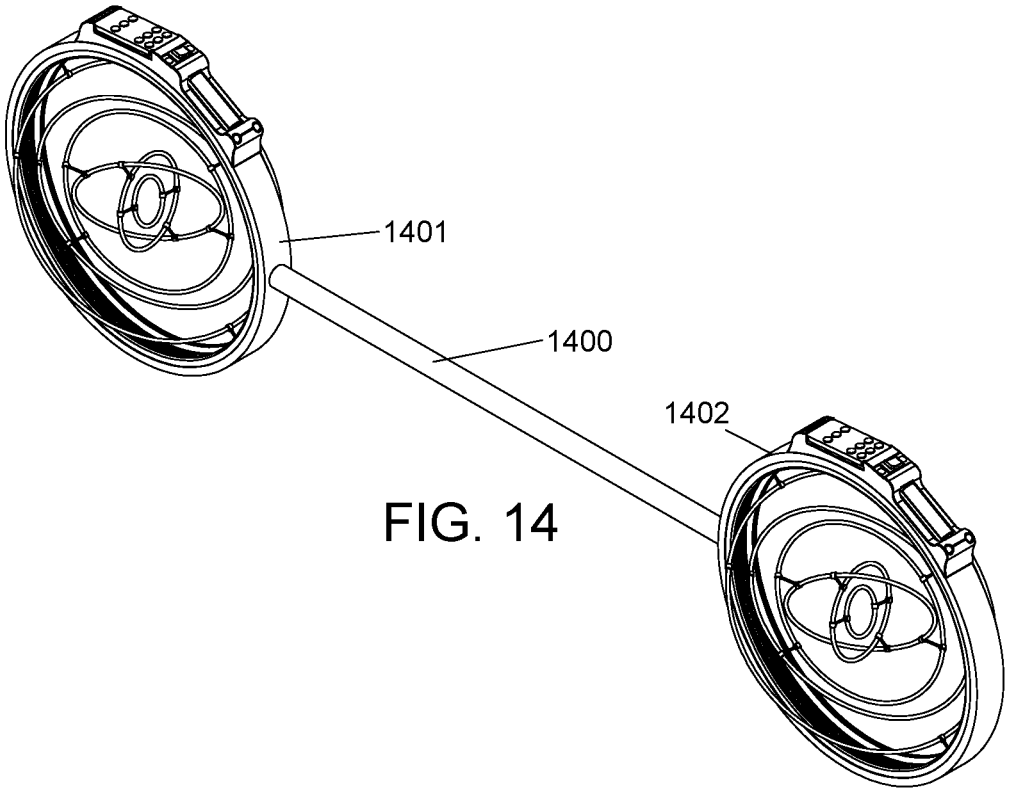
FIG. 14 shows an embodiment in which a plurality of frames is connected via a staff accessory feature.

FIG. 14—An embodiment with a staff accessory feature.

FIG. 14 shows an embodiment in which a plurality of elements is attached through the use of a staff accessory feature 1400. In this embodiment, frames 1401 and 1402 are connected. To use this embodiment or others that share a similar staff accessory feature, a user may first choose to turn on the one or more electronic elements using one or more electronic user controls. A user may then grasp this embodiment by the staff accessory feature, manipulating it to induce motion in one or more reflective elements. A staff accessory feature may facilitate use as a dancing prop in one or more embodiments.

Figure 15:
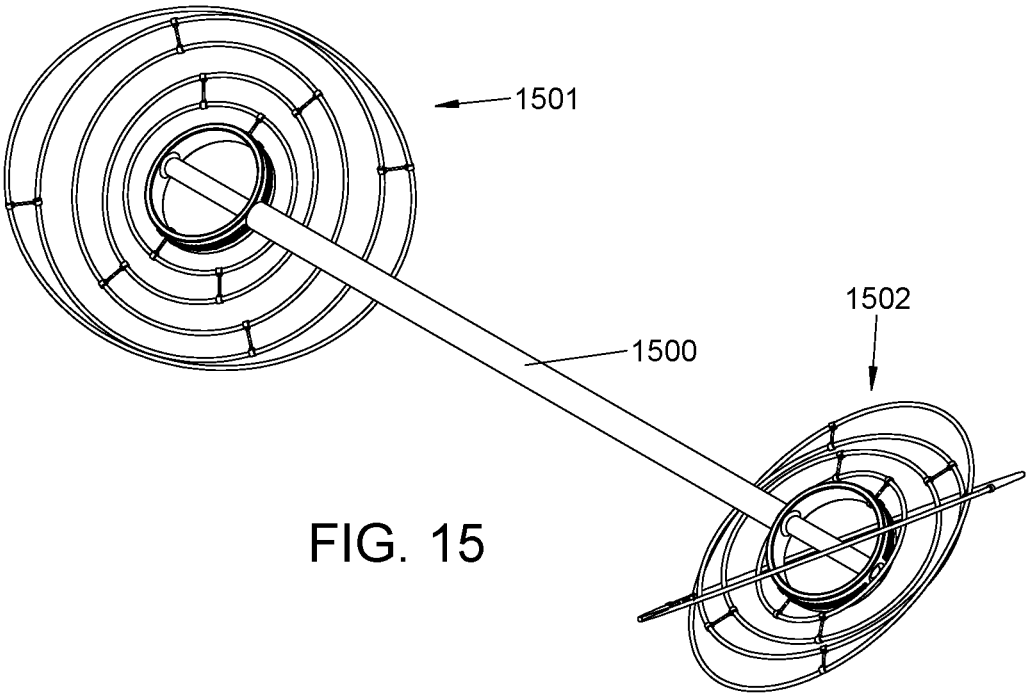
FIG. 15 shows an alternative embodiment in which a plurality of frames is connected via a staff accessory feature.

FIG. 15—An alternative embodiment with staff accessory feature.

FIG. 15 shows an alternative embodiment in which a plurality of elements is attached through a staff accessory feature 1500. In this embodiment, at least one of the elements in reflective assemblies 1501 and 1502 are located externally to their respective frames.

Figure 16:
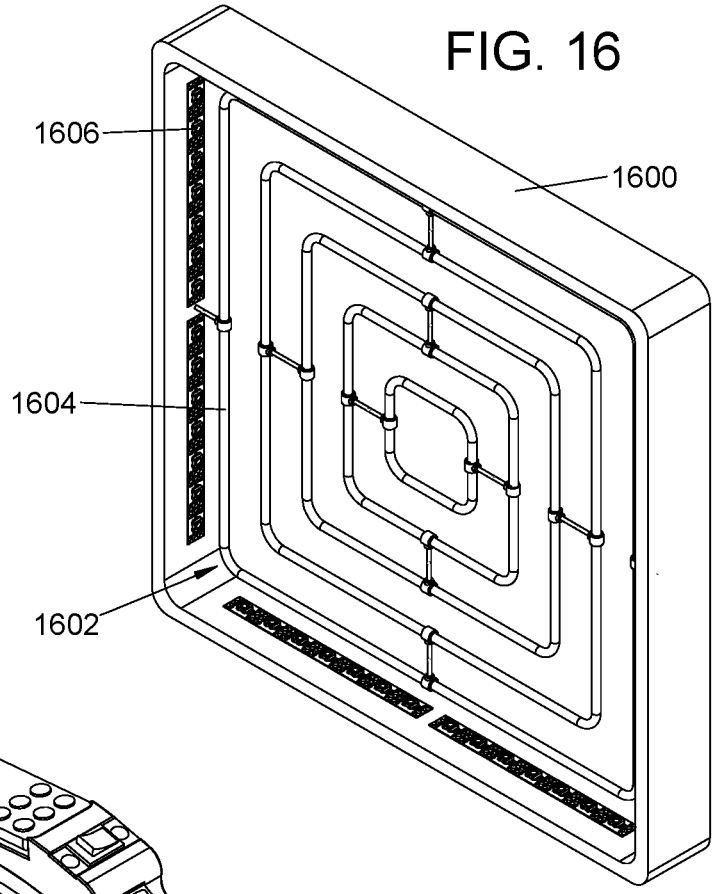
FIG. 16 depicts an embodiment in which one or more elements possess a square-like form.

FIG. 16—An embodiment with one or more elements of square-like form.

An embodiment that possesses one or more elements of a square-like form in shown in FIG. 16. A frame 1600 is of a closed planar form, a square with filleted corners. One or more reflective elements in reflective assembly 1602 also exhibit a square-like form. One such element is reflective element 1604. A plurality of light sources, such as light source 1606, are attached to the interior face of the frame 1600.

Figure 17:
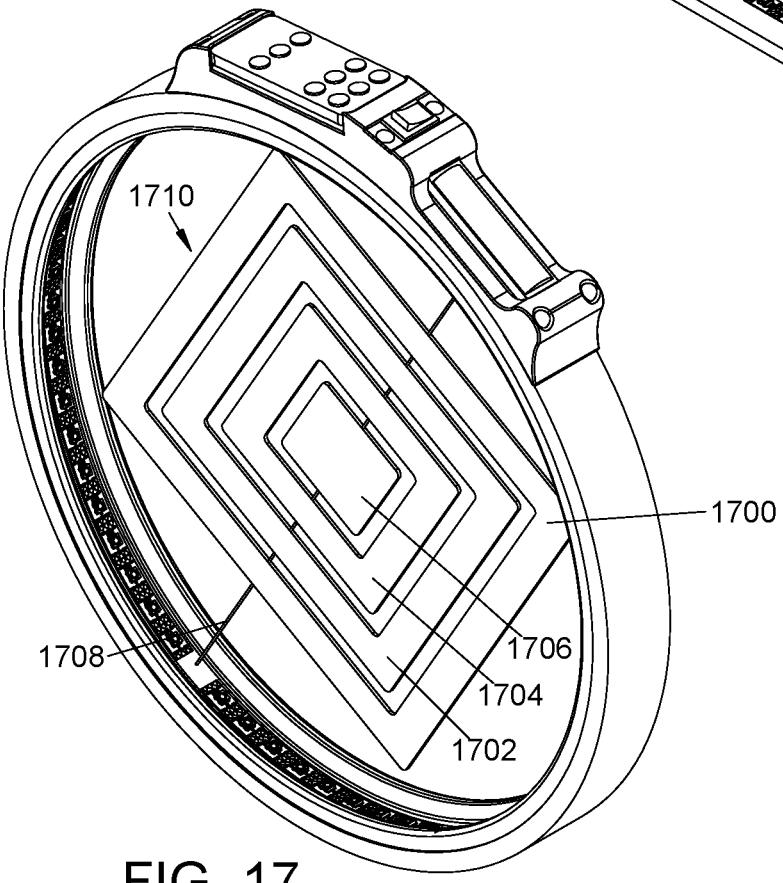
FIG. 17 depicts an embodiment in which one or more reflective elements are of a flat form.

FIG. 17—An embodiment with one or more flat reflective elements.

In FIG. 17, reflective assembly 1710 includes a number of reflective elements of flat form 1700, 1702, 1704, and 1706. These elements are attached among each other and the frame by at least one connecting element 1708. In this embodiment and one or more others, one or more reflective elements may be manufactured from sheet metals. The metal character provides added reflectance, as well the opportunity to apply various surface finishes. For instance, flat metal forms may be polished to have a high reflectance. Flat metal forms may also be sanded or "grained," producing a striated finish. The striated finish that results from sanding produces interesting results upon illumination. Due to microscopic troughs carved into the metal, a point-like light source will be expressed as an elongated beam of light in the metal it illuminates. Reflective elements of a flat metal form may be produced by stamping, laser cutting, plasma cutting, water jet cutting, other manufacturing techniques known to sheet metal fabricators, or a combination of these. Chemical treatment may yield alternative reflective properties in sheet metal forms.

DRAWINGS—REFERENCE NUMERALS

100 frame
101 reflective element
102 reflective element
103 reflective element
104 connecting element
105 connecting element
106 connecting element
107 connecting element
108 attachment feature of connecting element 107
109 attachment feature of connecting element 107
110 connecting element that attaches to the frame
111 connecting element that attaches to the frame
112 reflective assembly
113 light source
114 light source assembly
115 feature for partial concealment of one or more light sources
116 feature for partial concealment of one or more light sources
117 electronic user control
118 second electronic user control
120 power source
122 power source compartment
124 enclosure
126 enclosure assembly
128 chamfer feature
130 cavity
200 propulsive element
201 frame
202 connecting element
204 reflective element
206 reflective element
208 reflective element
300 frame of an open planar form
302 light source
304 reflective assembly
306 connecting element with a bearing
400 frame of a closed multi-planar form
402 reflective assembly
500 frame of an open multi-planar form
502 reflective assembly
600 connecting element
602 reflective assembly
604 propulsive element
606 frame
608 electronic user control
700 reflective element
702 connecting element
800 complex reflective element of a wire lattice form
802 union feature
900 frame
902 light source
904 reflective assembly
906 crossmember feature
1000 reflective element
1001 reflective element
1002 reflective element
1004 connecting element
1006 non-hierarchical reflective assembly
1100 stand assembly
1101 frame
1102 portable power source
1103 external power source
1104 propulsive element
1200 stand base
1201 stand cradle
1202 magnet
1203 magnet
1204 connective hardware
1205 electrical contacts
1300 hole
1302 threaded hardware
1304 bracket
1305 fastener
1306 clip
1308 rotatable knob
1310 rotatable hook
1312 staff
1314 rotatable handle
1316 strap
1400 staff accessory feature
1401 frame
1402 frame
1500 staff accessory feature
1501 reflective assembly
1502 reflective assembly
1600 frame of closed planar form
1602 reflective assembly
1604 reflective element of a square-like shape

1606 light source
1700 outer flat sheet reflective element
1702 an inner flat sheet reflective element
1704 an inner flat sheet reflective element
1706 an inner flat sheet reflective element
1708 connecting element
1710 reflective assembly utilizing flat elements

CONCLUSION

With this Application, several embodiments of the invention, including the best mode contemplated by the inventors, have been disclosed. It will be recognized that, while specific embodiments may be presented, elements discussed in detail only for some embodiments may also be applied to others.

While specific materials, designs, configurations, platforms and process steps have been set forth to describe this invention and several embodiments, such descriptions are not intended to be limiting. Specificities should not be construed as limitations on the scope, but rather as an exemplification of several embodiments thereof. Many other variations are possible. Modifications and changes may be apparent to those skilled in the art, and it is intended that this invention be limited only by the scope of the appended claims.

The invention claimed is:

1. A reflected light device, comprising:

at least one plurality of reflective elements, wherein the shape of at least one element of said plurality of reflective elements allows said plurality to achieve at least one nested hierarchical arrangement;

at least one frame, which substantially surrounds said at least one plurality of reflective elements and which is attached to;

at least one connecting element, which acts at least in part as a torsional spring and which provides rotatable interconnection among said at least one frame and said reflective elements such that said plurality of elements results in at least one nested multiple degree-of-freedom pendulum;

at least one plurality of light sources, attached to and largely distributed on said at least one frame and which are largely directed at said at least one plurality of reflective elements, with said at least one plurality of light sources being largely capable of dynamic variation in color;

at least one concealment feature incorporated to said at least one frame and that may partially occult at least one said plurality of light sources, whereby a dazzling display is created as said plurality of reflective elements lose their apparent natural color and take on the quality of the dynamically varying light provided by said at least one plurality of largely concealed light sources, with further novelty emergent from the synergy of said dynamically varying light with the chaotic kinematic capabilities of said at least one multiple degree-of-freedom pendulum of nested reflective elements.

2. The device of claim 1, wherein said frame is largely hoop-shaped and wherein at least two of said reflective elements of said at least one plurality of reflective elements are largely ring-shaped and of differing size such that said at least two reflective elements may be largely concentrically located to form said at least one nested hierarchical arrangement.

3. The device of claim 1, wherein reflectivity of at least one said reflective element of said at least one plurality of reflective elements is achieved through metal plating.

4. The device of claim 1, further comprising a plurality of connecting elements arranged in at least two pairs, wherein said connecting elements of a given said pair are largely aligned on a common axis and are attached to largely opposite ends of the at least one said reflective element to which given said pair connects and wherein said axis of one said pair of connecting elements differs in alignment angle from said axis of at least one other said pair, whereby said alignment angle difference facilitates complex motions of at least two said reflective elements of said nested plurality of reflective elements.

5. The device of claim 1, wherein said at least one frame has a largely planar form, with said at least one plurality of light sources and said at least one concealment feature substantially applied along the inner perimeter of said at least one largely planar frame.

6. The device of claim 1, further comprising a stand.

7. The device of claim 1, further comprising a propulsive element.

8. A reflected light device, comprising:

at least one frame of largely planar form, which is rotatably attached to and substantially surrounds;

at least one plurality of reflective elements, wherein the shape of at least one element within said plurality of reflective elements allows said plurality to form at least one nested hierarchical arrangement, and wherein said reflective elements are rotatably interconnected by;

at least one connecting element that is at least in part a torsional spring, which provides rotatable interconnection among said at least one plurality of reflective elements and said at least one frame such that said at least one plurality of reflective elements results in at least one nested multiple degree-of-freedom pendulum;

at least one plurality of light sources, substantially arranged in at least one strip and largely attached along the perimeter of said at least one planar frame, such light emitted by said at least one plurality of light sources may substantially illuminate said at least one plurality of reflective elements from a variety of directions;

at least one concealment feature, largely perimetrically incorporated to said at least one planar frame and substantially occulting said at least one plurality of light sources such that said light sources are largely hidden from view;

whereby a novel illuminated display is created through the interaction of the unpredictable kinematic behavior of said at least one multiple degree-of-freedom pendulum of nested reflective elements with light emitted by said at least one plurality of light sources and enhanced by the occultation effect provided by said at least one concealment feature along the perimeter of said at least one frame.

9. The device of claim 8, wherein said light sources of said at least one plurality of light sources are largely addressable, whereby dynamic lighting effects originating in said at least one plurality of largely addressable light sources are subsequently reflected by said at least one plurality of reflective elements.

10. The device of claim 8, wherein reflectivity of at least one said reflective element of said at least one plurality of reflective elements is achieved through metal plating.

11. The device of claim 8, wherein said largely planar frame is substantially a hoop in shape and wherein at least two of said plurality of reflective elements are largely ring-shaped and of different size such that said two reflective elements may be largely concentrically located to form at least one nested hierarchical arrangement.

12. The device of claim 8, wherein at least one of said plurality of reflective elements are comprised of sheet metal.

13. The device of claim 8, further comprising a plurality of connecting elements arranged in at least two pairs, wherein said connecting elements of a given said pair are largely aligned on a common axis and are attached to largely opposite ends of the at least one said reflective element to which given said pair connects and wherein said axis of one said pair of connecting elements differs in alignment angle from said axis of at least one other said pair of a different said hierarchy, whereby said alignment angle difference facilitates complex motions of at least two of said plurality of reflective elements.

14. The device of claim 8, further comprising at least one propulsive element to at least induce motion in at least one said plurality of reflective elements.

15. The device of claim 8, further comprising at least one stand.

16. The device of claim 8, wherein said at least one concealment feature is a channel and wherein said at least one plurality of light sources largely reside in the groove formed by said channel.

17. A reflected light device, comprising:

at least one frame of largely planar shape, which is attached to and substantially surrounds;

at least one plurality of reflective elements, wherein said plurality of reflective elements is largely comprised of plated metal forms of varying size such that said plurality may form at least one nested hierarchical arrangement, and wherein said reflective elements and said at least one frame are rotatably interconnected by;

at least one plurality of torsional spring connecting elements arranged in at least two pairs, wherein both said connecting elements of a given said pair are aligned along a common axis, wherein each connecting element of a given said pair attaches to largely opposing sides of a given said reflecting element, and wherein one said connecting element pair of a given said hierarchy is aligned to a largely different rotation axis than another said connecting element pair of an adjacent said hierarchy;

at least one plurality of largely individually controlled light sources, largely arranged in at least one strip and substantially attached along the interior perimeter of said largely planar frame such that multicolored and dynamically varying light emitted by said at least one plurality of light sources may substantially illuminate said at least one plurality of reflective elements from a variety of directions, with;

at least one user control to at least allow patterns displayed on said plurality of light sources to change;

at least one concealment feature, perimetrically incorporated to said interior face of said largely planar frame and with said at least one plurality of light sources largely hidden by said at least one concealment feature;

whereby a unique illuminated display is created from the dynamic interaction of the unique pendulating activity of said plurality of said reflective element plurality resultant from said torsion spring connecting pairs with multicolored and varying light emitted by said plurality of light sources hidden in said concealment feature, with further novelty emerging from the tendency of said at least one plurality of reflective elements to lose its apparent natural color and take on the varying colors of said hidden light sources that substantially surround said reflective elements.

18. The device of claim 17, further comprising at least one propulsive element.

19. The device of claim 17, further comprising at least one stand.

20. The device of claim 17, wherein said at least one user control may enable a motion-control mode, whereby light emitted by said at least one plurality of light sources may change in response to movement applied to said device.

* * * * *